US009409428B2

(12) United States Patent
Shuto et al.

(10) Patent No.: US 9,409,428 B2
(45) Date of Patent: Aug. 9, 2016

(54) RECORDING APPARATUS

(71) Applicant: SEIKO EPSON CORPORATION, Tokyo (JP)

(72) Inventors: Ryoichi Shuto, Kitakyushu (JP); Kazuhiko Tsuyama, Kitakyushu (JP); Naoki Sakamoto, Kitakyushu (JP); Hiroyuki Tajima, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/732,122

(22) Filed: Jun. 5, 2015

(65) Prior Publication Data

US 2015/0360488 A1 Dec. 17, 2015

(30) Foreign Application Priority Data

Jun. 12, 2014 (JP) ..... 2014-121354
Jun. 25, 2014 (JP) ..... 2014-130370

(51) Int. Cl.

| | |
|---|---|
| ***B41J 25/304*** | (2006.01) |
| ***B41J 2/01*** | (2006.01) |
| ***B41J 1/00*** | (2006.01) |
| ***B41J 23/02*** | (2006.01) |
| ***B41J 29/02*** | (2006.01) |
| ***B41J 19/20*** | (2006.01) |

(52) U.S. Cl.
CPC *B41J 25/304* (2013.01); *B41J 1/00* (2013.01); *B41J 2/01* (2013.01); *B41J 19/202* (2013.01); *B41J 23/025* (2013.01); *B41J 29/02* (2013.01); *B41J 29/023* (2013.01)

(58) Field of Classification Search
CPC ..... B41J 19/202; B41J 2/1752; B41J 25/34; B41J 19/005; B41J 25/304
USPC ..... 347/37
See application file for complete search history.

(56) References Cited

U.S. PATENT DOCUMENTS

| | | | | |
|---|---|---|---|---|
| 5,184,902 | A | 2/1993 | Harada et al. | |
| 5,245,362 | A | 9/1993 | Iwata et al. | |
| 5,842,795 | A | 12/1998 | Narita et al. | |
| 2002/0021343 | A1 * | 2/2002 | Uchida | B41J 29/13 347/108 |
| 2004/0067089 | A1 * | 4/2004 | Tanaami | B41J 29/02 400/693 |

FOREIGN PATENT DOCUMENTS

| | | | | |
|---|---|---|---|---|
| EP | 2682271 | | 1/2014 | |
| JP | 2005-022273 | * | 1/2005 | B41J 2/01 |
| JP | 2005-022273 | A | 1/2005 | |
| JP | 2006-347059 | A | 12/2006 | |
| JP | 2009-165268 | A | 7/2009 | |

OTHER PUBLICATIONS

European Search Report for Application No. 15171841.8 dated Oct. 23, 2015.

* cited by examiner

*Primary Examiner* — Manish S Shah
*Assistant Examiner* — Yaovi M Ameh
(74) *Attorney, Agent, or Firm* — Workman Nydegger

(57) ABSTRACT

A printer includes a carriage which includes an ink jet recording head and is movable in a first direction and a second direction that is an opposite direction to the first direction, a gear group which transmits power of a motor to a sheet transporter, a transporter drive motor which transmits power to the gear group, and a carriage drive motor which drives the carriage. At least a portion of the carriage drive motor and at least a portion of the gear group are at the same position as each other in a movement direction (x direction) of the carriage.

19 Claims, 19 Drawing Sheets

RECORDING APPARATUS

BACKGROUND

1. Technical Field

The present invention relates to a recording apparatus which is represented by a facsimile, a printer, or the like.

2. Related Art

A printer which is an example of a recording apparatus includes a so-called serial type printer which completes a recording by alternately performing a predetermined amount of sheet transport operation and a recording operation in accordance with a movement of a carriage including a recording head to a sheet width direction. In the serial type printer, a carriage drive motor and a transport motor which drives a transport roller performing a sheet transport are provided as shown in JP-A-2006-347059 and JP-A-2005-22273, and a recording is performed onto a recording sheet by appropriately controlling each of these motors.

Incidentally, there are demands for further reduction in size of a printer in recent years. In particular, further reduction in size is requested in a mobile-type printer which is assumed to be carried by a user.

Some of the mobile-type printers operate using power which is AC-DC converted by an external AC adapter. A connection section to which a connection section plug of the AC adapter is connected is provided in such printers. In JP-A-2009-165268, an example of a recording apparatus including such a connection section is disclosed. The connection section is generally arranged on a rear surface of an apparatus or a side surface of the apparatus in many cases.

Here, a width dimension of the printer is generally determined by a width of a movement region of a carriage and a size or a position of components provided on an outer side of the movement region.

In a printer of the related art, a carriage drive motor, a transport motor, a drive mechanism (for example, gear group) which transmits the transport motor to a transport roller, and the connection section described above cause a dimension of the apparatus to be increased.

SUMMARY

An advantage of some aspects of the present invention is to further reduce a size of a recording apparatus which includes a carriage drive motor, a transport motor, a drive mechanism which transmits the transport motor to a transport roller, and a connection section to which an external power supply source is connected.

According to an aspect of the invention, there is provided a recording apparatus, including a carriage which includes a recording head performing a recording on a medium and is moveable in a predetermined direction, a carriage drive motor which drives the carriage, a transporter which transports the medium, a transporter drive motor which drives the transporter, and a power transmission mechanism which transmits power of the transporter drive motor to the transporter, in which at least a portion of the carriage drive motor and at least a portion of the power transmission mechanism are located at the same position as each other in a movement direction of the carriage.

In this case, at least a portion of the carriage drive motor and at least a portion of the power transmission mechanism are located at the same position as each other in the movement direction of the carriage, such that a dimension of each of the carriage drive motor and the power transmission mechanism is not independently added to a dimension of an apparatus in the movement direction of the carriage, and thereby the dimension of the apparatus in the movement direction of the carriage can be suppressed.

In the recording apparatus, at least a portion of the power transmission mechanism may be located on a bottom side of the carriage drive motor.

In this case, at least a portion of the power transmission mechanism is positioned on the bottom side of the carriage drive motor, such that both a dimension of the apparatus in the movement direction of the carriage and a dimension of the apparatus in a direction intersecting with the movement direction of the carriage can be suppressed.

In the recording apparatus, at least a portion of the carriage drive motor and at least a portion of the power transmission mechanism may be located at the same position as each other in a vertical direction.

In this case, at least a portion of the carriage drive motor and at least a portion of the power transmission mechanism are located at the same position as each other in the vertical direction, such that a dimension of each of the carriage drive motor and the power transmission mechanism is not independently added to a dimension of the apparatus in the vertical direction, and thereby the dimension of the apparatus in the vertical direction can be suppressed.

In the recording apparatus, the recording apparatus may further include a frame which extends in a direction intersecting with the movement direction of the carriage in an end region on one side in a movement region of the carriage, in which the power transmission mechanism includes a plurality of gears which are arranged in an extending direction of the frame.

In this case, the plurality of gears included in the power transmission mechanism are arranged in the extending direction of the frame, such that a space occupied by the power transmission mechanism in the movement direction of the carriage can be reduced.

In the recording apparatus, at least a portion of the carriage drive motor and at least a portion of the transporter drive motor may be located at the same position as each other in the vertical direction.

In this case, at least a portion of the carriage drive motor and at least a portion of the transporter drive motor are located at the same position as each other in the vertical direction, such that a dimension of each of the carriage drive motor and the transporter drive motor is independently added to a dimension of the apparatus in the vertical direction, and thereby the dimension of the apparatus in the vertical direction can be suppressed.

According to another aspect of the invention, there is provided a recording apparatus, including a carriage which includes a recording head performing a recording on a medium and is movable in a predetermined direction, a carriage drive motor which drives the carriage, a transporter which transports the medium, a transporter drive motor which drives the transporter, and a power transmission mechanism which transmits power of the transporter drive motor to the transporter, in which at least a portion of the carriage drive motor and at least a portion of the transporter drive motor are located at the same position as each other in a vertical direction.

In this case, at least a portion of the carriage drive motor and at least a portion of the transporter drive motor are located at the same position as each other in the vertical direction, such that a dimension of each of the carriage drive motor and the transporter drive motor is not independently added to a dimension of the apparatus in the vertical direction, and thereby the dimension of the apparatus in the vertical direction can be suppressed.

In the recording apparatus, at least a portion of the carriage drive motor and at least a portion of the transporter drive motor may be located at the same position as each other in the movement direction of the carriage.

In this case, at least a portion of the carriage drive motor and at least a portion of the transporter drive motor are located at the same position as each other in the movement direction of the carriage, such that a dimension of each of the carriage drive motor and the transporter drive motor is independently added to a dimension of the apparatus in the movement direction of the carriage, and thereby the dimension of the apparatus in the movement direction of the carriage can be suppressed.

In the recording apparatus, at least a portion of the carriage drive motor and at least a portion of the transporter drive motor may be located at the same position as each other in a direction intersecting with the movement direction of the carriage.

In this case, at least a portion of the carriage drive motor and at least a portion of the transporter drive motor are located at the same position as each other in the direction intersecting with the movement direction of the carriage, such that a dimension of each of the carriage drive motor and the transporter drive motor is not independently added to a dimension of the apparatus in the direction intersecting with the movement direction of the carriage, and thereby the dimension of the apparatus in the direction intersecting with the movement direction of the carriage can be suppressed.

In the recording apparatus, the recording apparatus may further include a medium feeding section which feeds a medium, and a housing which accommodates an apparatus main body that includes the carriage, the carriage drive motor, the transporter, the transporter drive motor, the power transmission mechanism, and the medium feeding section, in which the medium feeding section includes a medium setting unit which sets a medium, and the carriage drive motor is arranged between the housing and the medium setting unit.

In this case, the carriage drive motor is arranged between the housing and the medium setting unit, such that the apparatus can be suppressed not to be increased in size by arranging the carriage drive motor using a narrow space between the housing and the medium setting unit.

In the recording apparatus, at least a portion of the power transmission mechanism may be positioned under the carriage which is moved to an end of a movable region of the carriage.

In this case, at least a portion of the power transmission mechanism is positioned under the carriage which is moved to the end of a movable region of the carriage, such that the power transmission mechanism gets into a region necessary for a movement of the carriage, and thereby a width dimension of the apparatus in the movement direction of the carriage can be suppressed.

In the recording apparatus, the recording apparatus may further include a connection section to which an external power supply source is connected, in which at least a portion of the carriage drive motor and at least a portion of the connection section are located at the same position as each other in the movement direction of the carriage.

In this case, at least a portion of the carriage drive motor and at least a portion of the connection section are located at the same position as each other in the movement direction of the carriage, such that a dimension of each of the carriage drive motor and the connection section is not independently added to a dimension of the apparatus in the movement direction of the carriage, and thereby the dimension of the apparatus in the movement direction of the carriage can be suppressed.

In the recording apparatus, the recording apparatus may further include the connection section to which the external power supply source is connected, in which at least a portion of the carriage drive motor and at least a portion of the connection section are located at the same position as each other in the vertical direction.

In this case, at least a portion of the carriage drive motor and at least a portion of the connection section are located at the same position as each other in the vertical direction, such that a dimension of each of the carriage drive motor and the connection section is not independently added to a dimension of the apparatus in the vertical direction, and thereby the dimension of the apparatus in the vertical direction can be suppressed.

In the recording apparatus, the recording apparatus may further include the connection section to which the external power supply source is connected, in which at least a portion of the transporter drive motor and at least a portion of the connection section are located at the same position as each other in the movement direction of the carriage.

In this case, at least a portion of the transporter drive motor and at least a portion of the connection section are located at the same position as each other in the movement direction of the carriage, such that a dimension of each of the transporter drive motor and the connection section is not independently added to a dimension of the apparatus in the movement direction of the carriage, and thereby the dimension of the apparatus in the movement direction of the carriage can be suppressed.

In the recording apparatus, the recording apparatus may further include the connection section to which the external power supply source is connected, in which at least a portion of the transporter drive motor and at least a portion of the connection section are located at the same position as each other in a direction intersecting with the movement direction of the carriage.

In this case, at least a portion of the transporter drive motor and at least a portion of the connection section are located at the same position as each other in the direction intersecting with the movement direction of the carriage, such that a dimension of each of the transporter drive motor and the connection section is not independently added to a dimension of the apparatus in the movement direction of the carriage, and thereby the dimension of the apparatus in the direction intersecting with the movement direction of the carriage can be suppressed.

In the recording apparatus, the recording apparatus may further include the connection section to which the external power supply source is connected, in which at least a portion of the power transmission mechanism and at least a portion of the connection section are located at the same position as each other in the movement direction of the carriage.

In this case, at least a portion of the power transmission mechanism and at least a portion of the connection section are located at the same position as each other in the movement direction of the carriage, such that a dimension of each of the power transmission mechanism and the connection section is not independently added to a dimension of the apparatus in the movement direction of the carriage, and thereby the dimension of the apparatus in the movement direction of the carriage can be suppressed.

In the recording apparatus, the connection section may include an input/output interface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to drawings. However, the invention is not limited to the embodiments to be described below, various modifications can be made within a scope of the invention described in the claims, and the modifications are assumed to be included in the scope of the invention, and thereby an embodiment of the following invention will be described.

Figure 1:
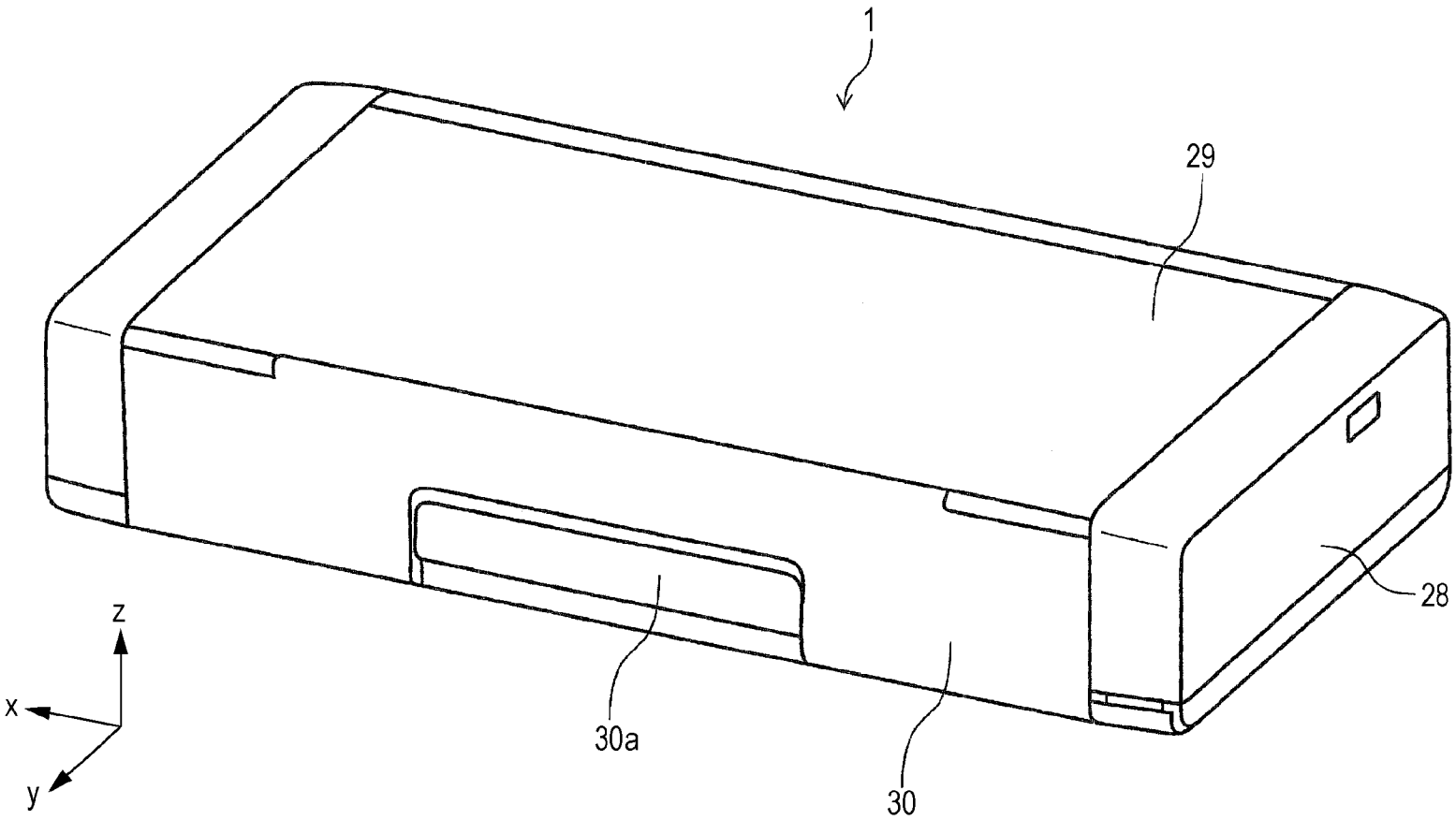
FIG. 1 is an external perspective view of a printer according to the invention.
Figure 2:
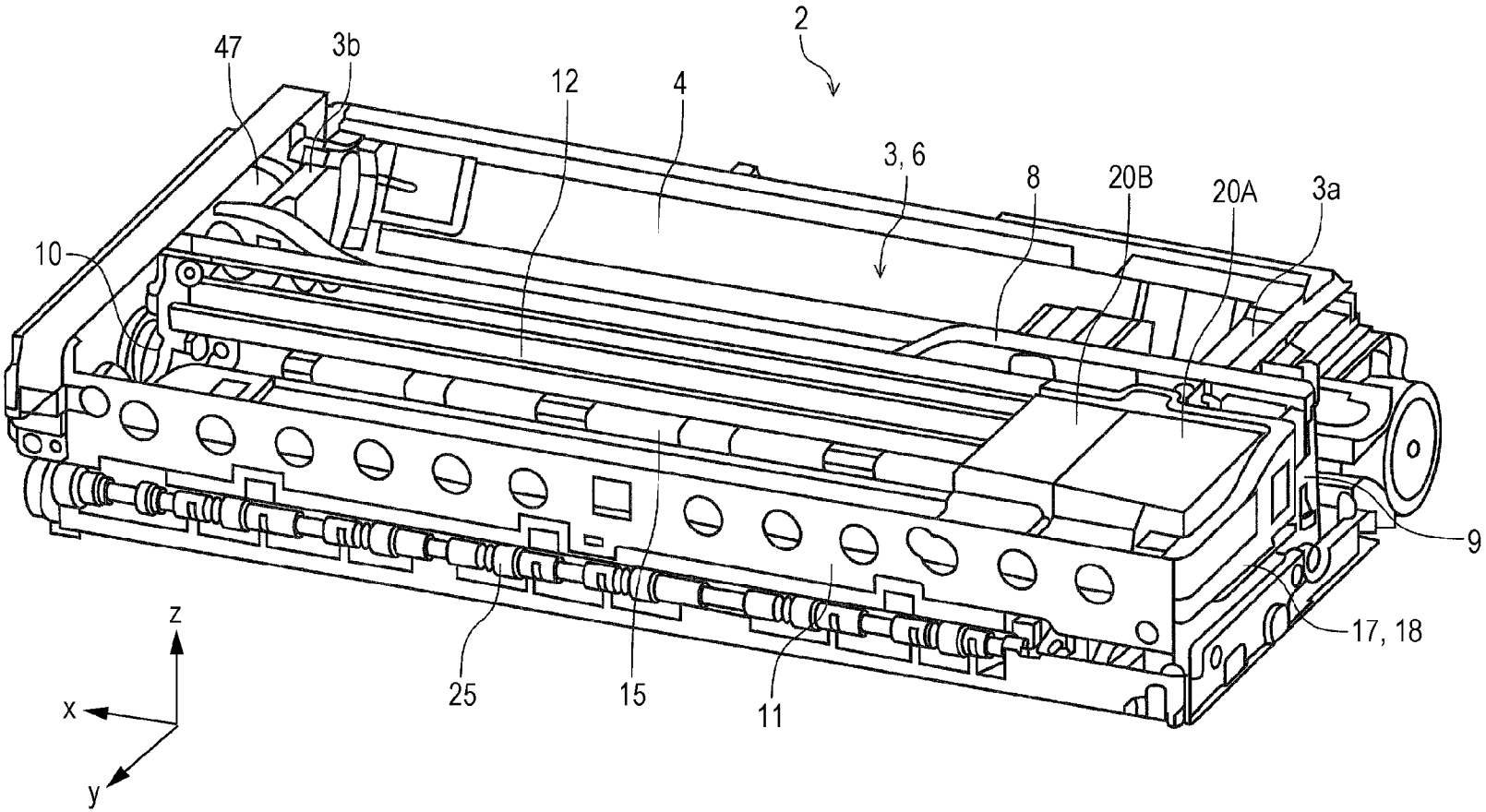
FIG. 2 is a perspective view of an apparatus main body of the printer according to the invention.
Figure 3:
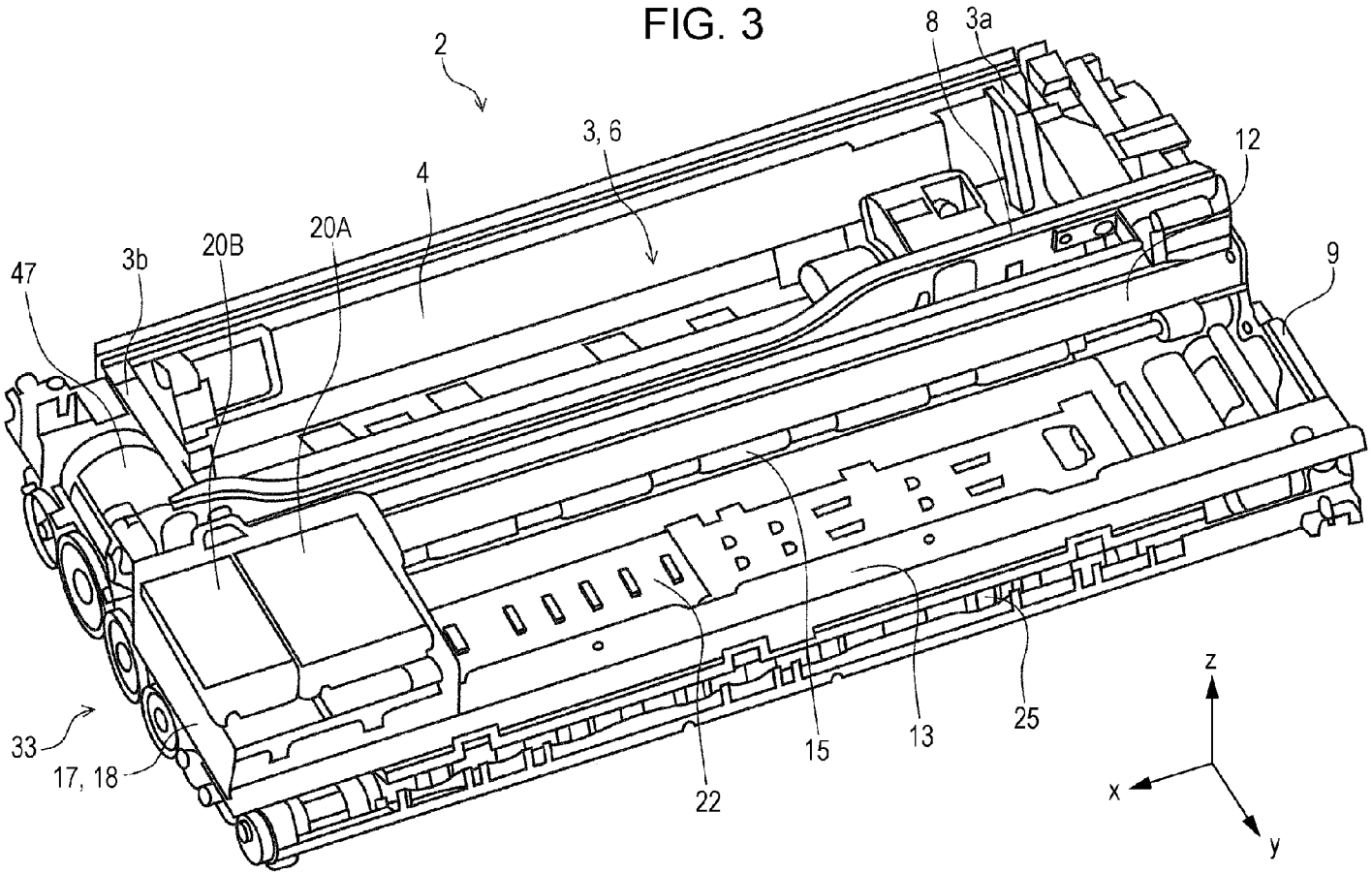
FIG. 3 is a perspective view of an apparatus main body of the printer according to the invention.
Figure 4:
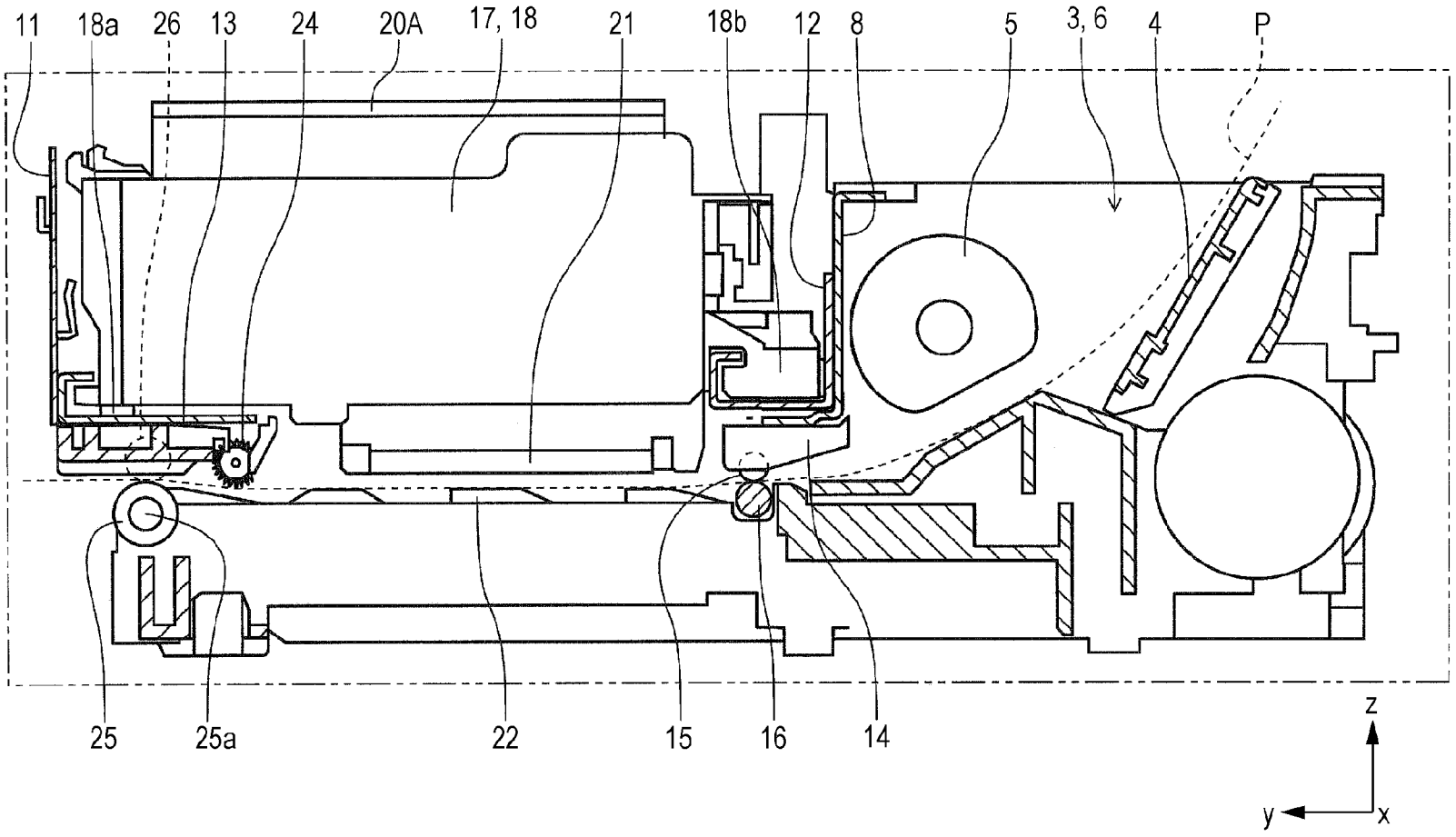
FIG. 4 is a side cross-sectional view which shows a sheet transport path of the printer according to the invention.

FIG. 1 is an external perspective view of an ink jet printer (hereinafter, referred to as "printer") 1 which is an embodiment of a "recording apparatus" according to the invention, FIGS. 2 and 3 are perspective views of an apparatus main body (a state in which a housing configuring an appearance is excluded) 2, and FIG. 4 is a side cross-sectional view which shows a sheet transport path of the printer 1.

Figure 5:
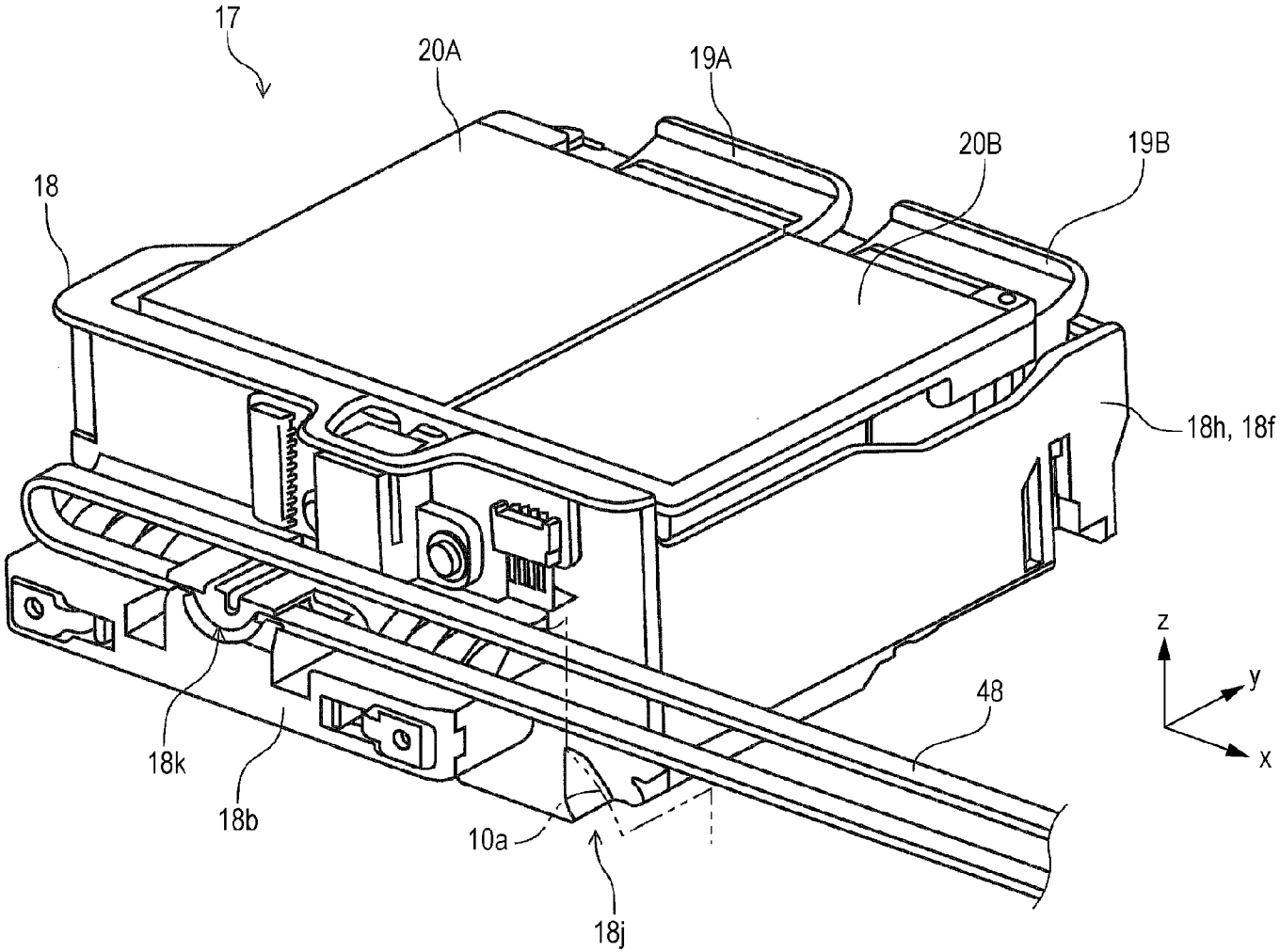
FIG. 5 is a perspective view of a carriage viewed obliquely from above a back of the apparatus.
Figure 6:
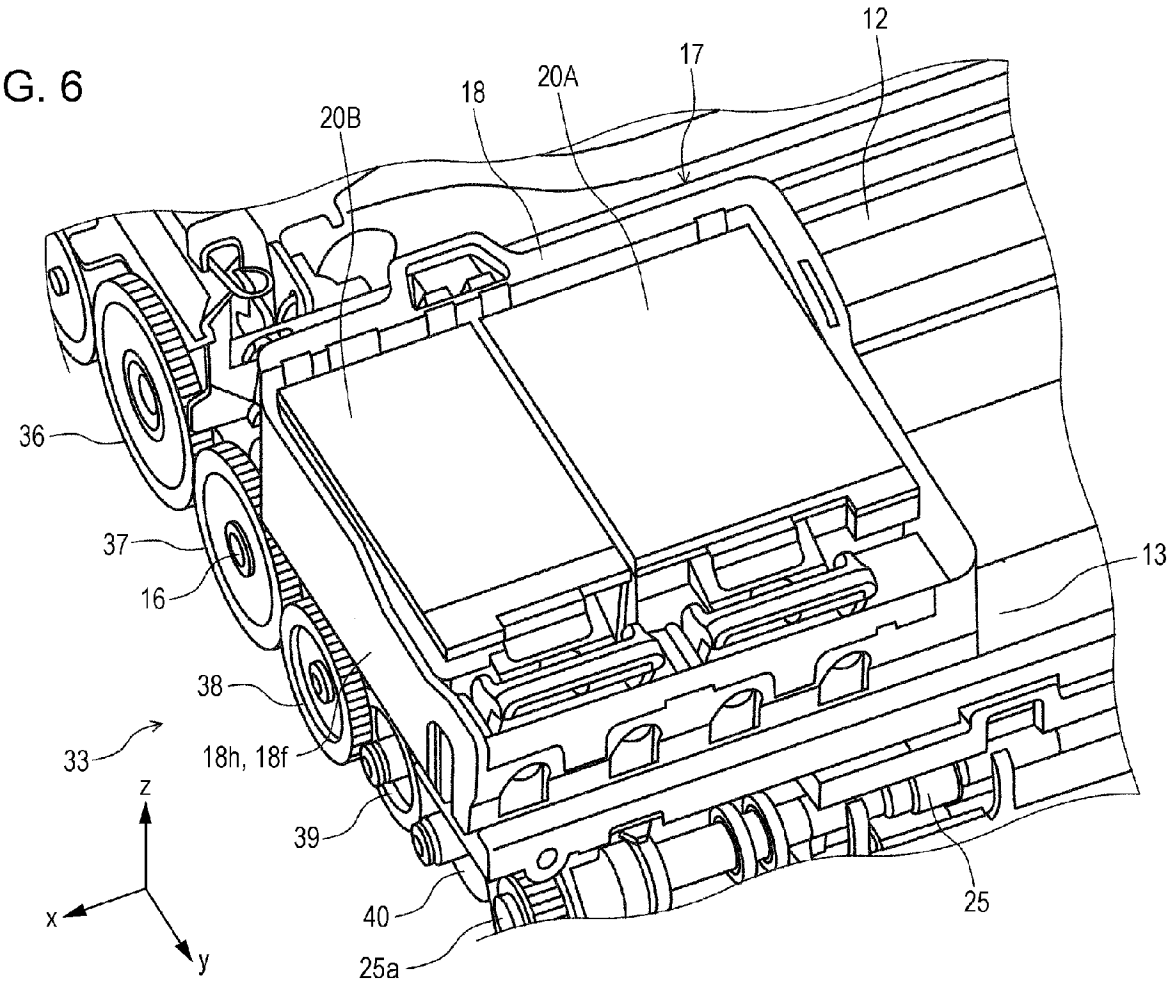
FIG. 6 is a perspective view which shows a state in which the carriage is positioned at a left end.
Figure 7:
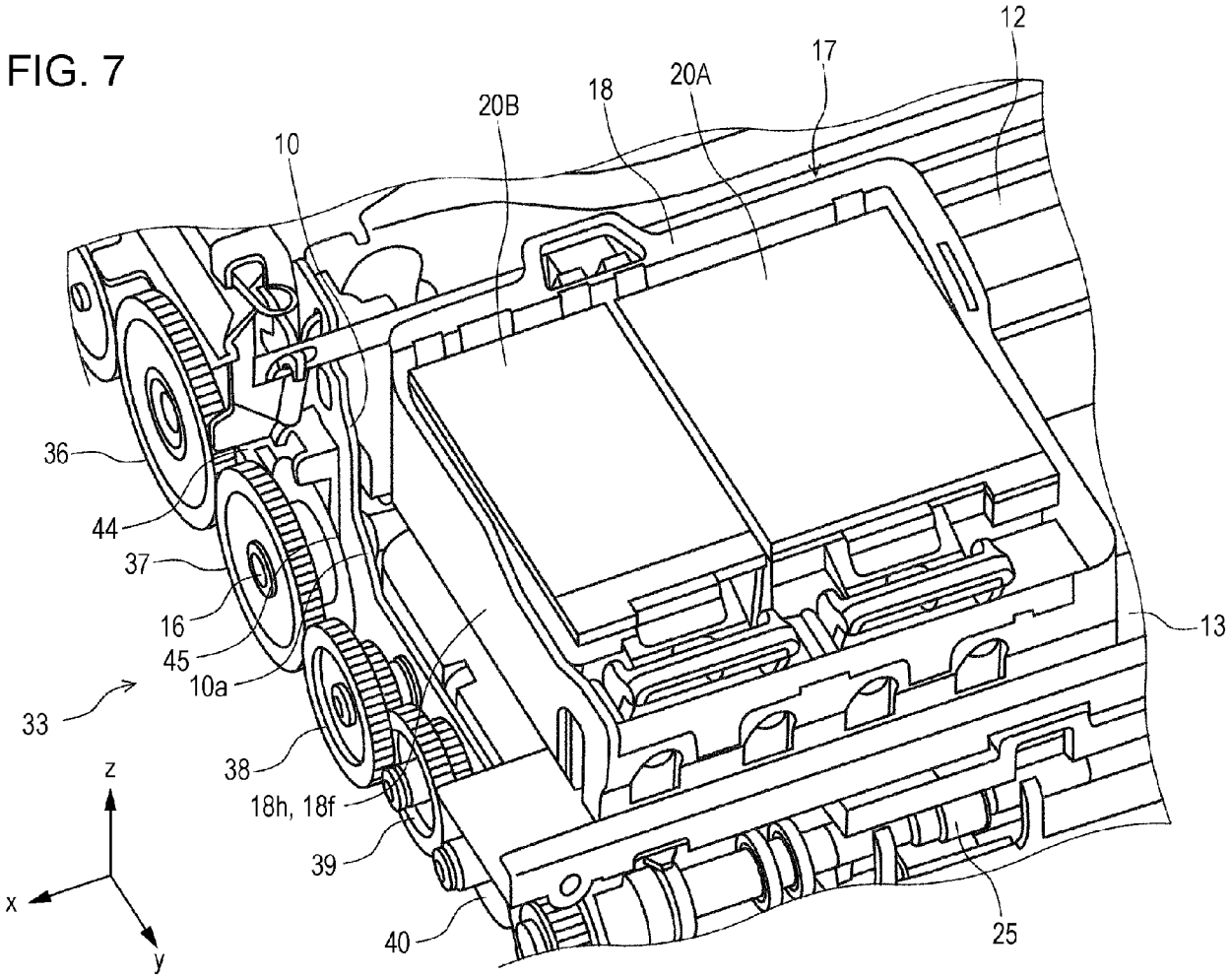
FIG. 7 is a perspective view which shows a state in which the carriage is positioned at a little further a home position side than the left end.
Figure 8:
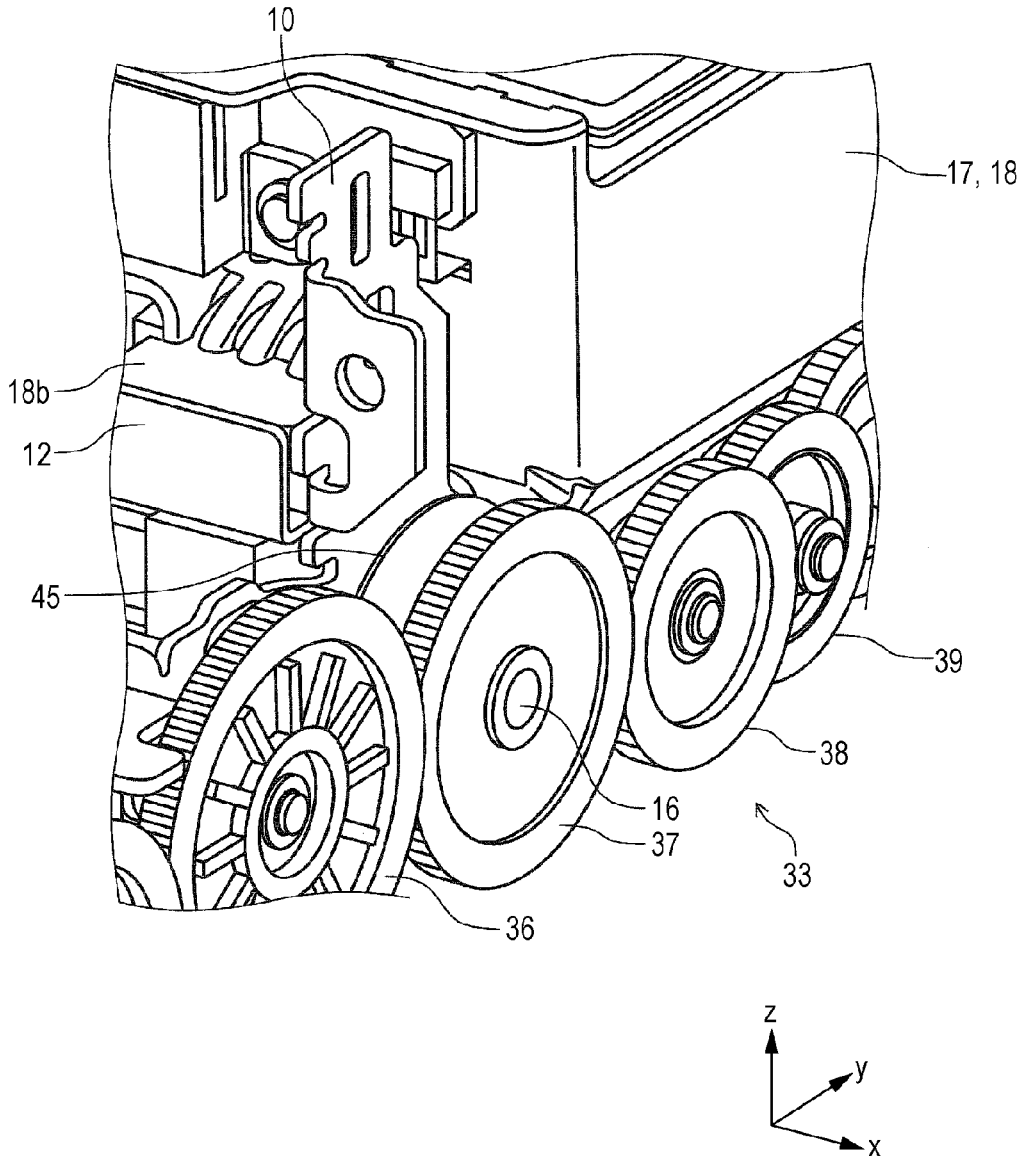
FIG. 8 is a perspective view which shows a gear group and a rotary scale.
Figure 9:
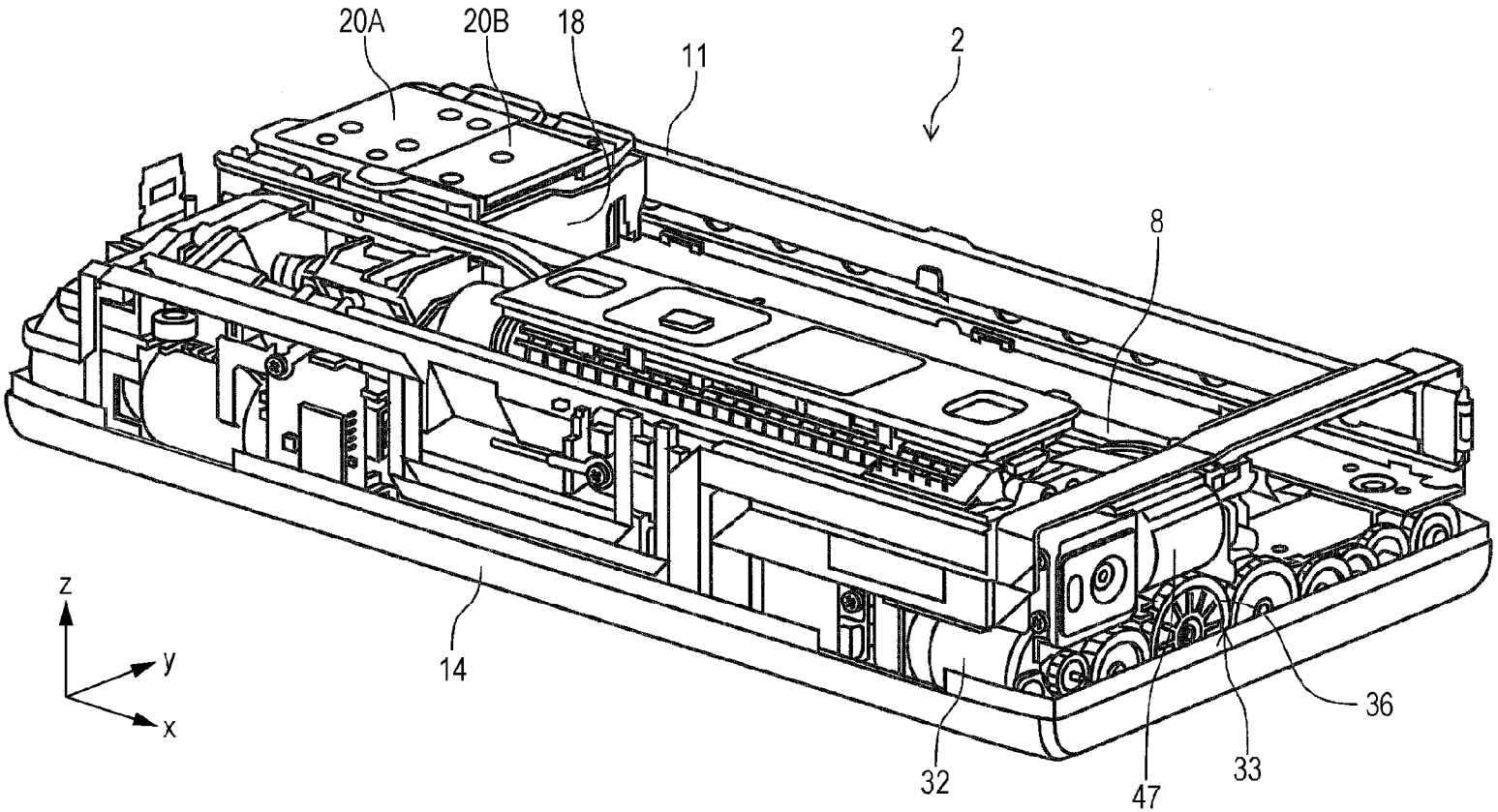
FIG. 9 is a perspective view of the apparatus main body of the printer according to the invention viewed from a rear side.
Figure 10:
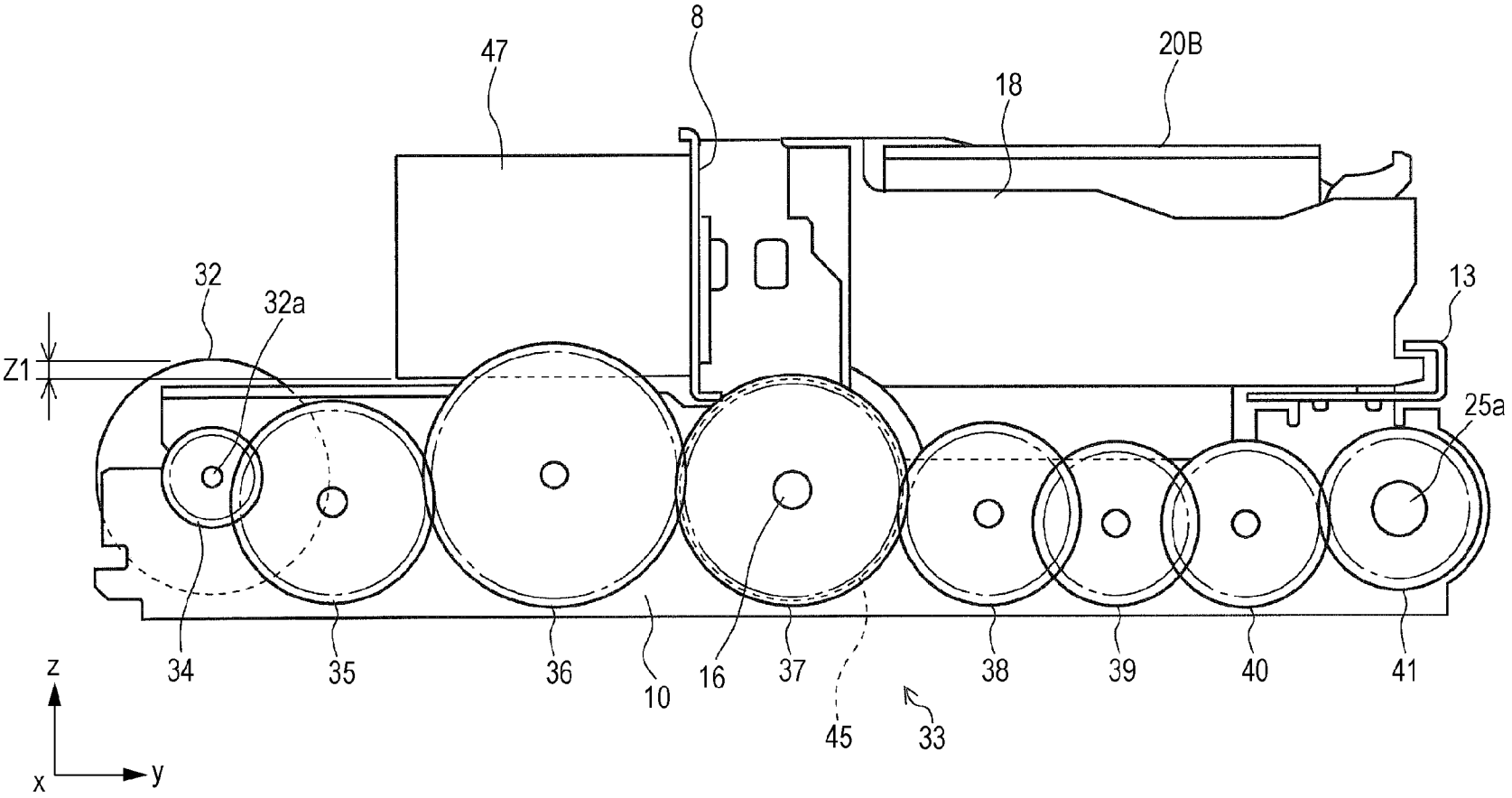
FIG. 10 is a front view of the gear group.
Figure 11:
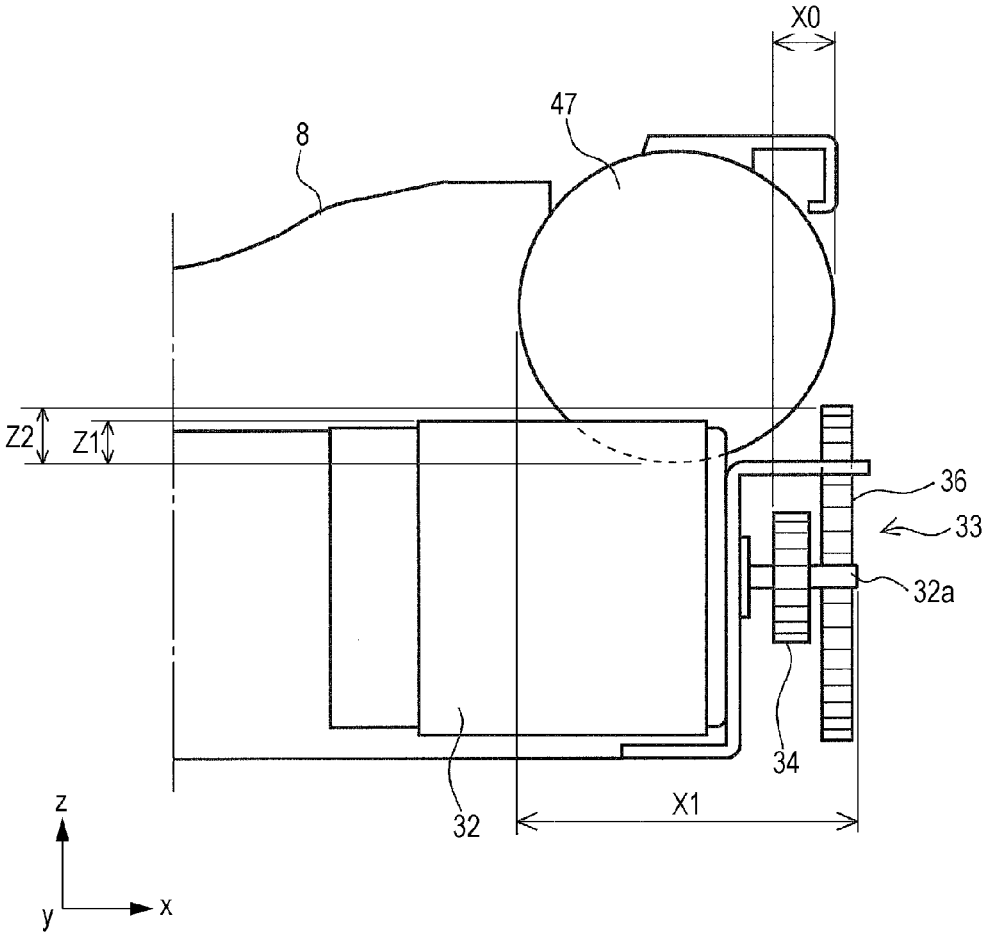
FIG. 11 is a front view of a transporter drive motor and a carriage drive motor viewed from the back of the apparatus.
Figure 12:
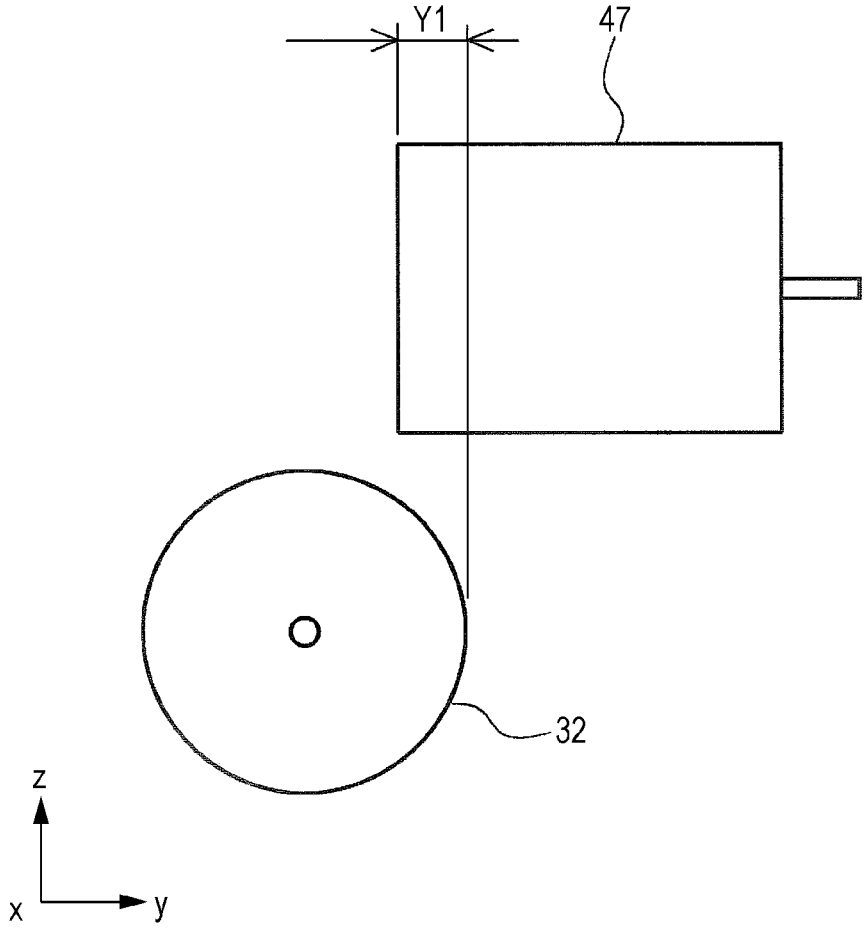
FIG. 12 is a view which shows an arrangement example of the transporter drive motor and the carriage drive motor.

In addition, FIG. 5 is a perspective view of a carriage 17 viewed obliquely from above a back of an apparatus, FIG. 6 is a perspective view which shows a state in which the carriage 17 is positioned at a left end, FIG. 7 is a perspective view which shows a state in which the carriage 17 is positioned at a little further a home position side than the left end, FIG. 8 is a perspective view which shows a gear group 33 and a rotary scale 45, FIG. 9 is a perspective view of an apparatus main body 2 of the printer 1 viewed from the back of the apparatus, FIG. 10 is a front view of the gear group 33, and FIG. 11 is a front view of a transporter drive motor 32 and a carriage drive motor 47 viewed from the back of the apparatus. Furthermore, FIG. 12 is a view which shows an arrangement example of the transporter drive motor 32 and the carriage drive motor 47.

Figure 13:
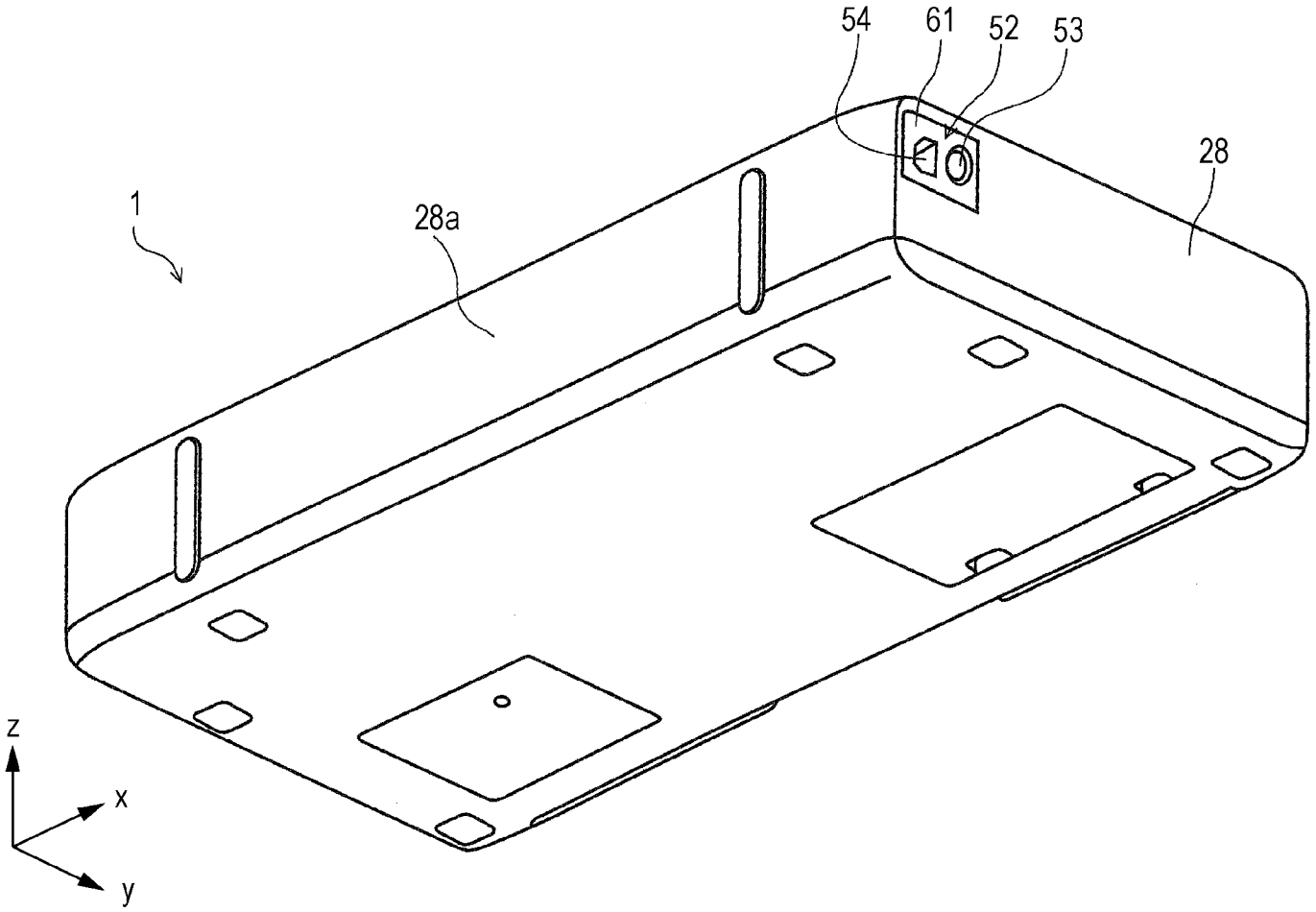
FIG. 13 is an external perspective view of the printer according to the invention viewed from a bottom side.
Figure 14:
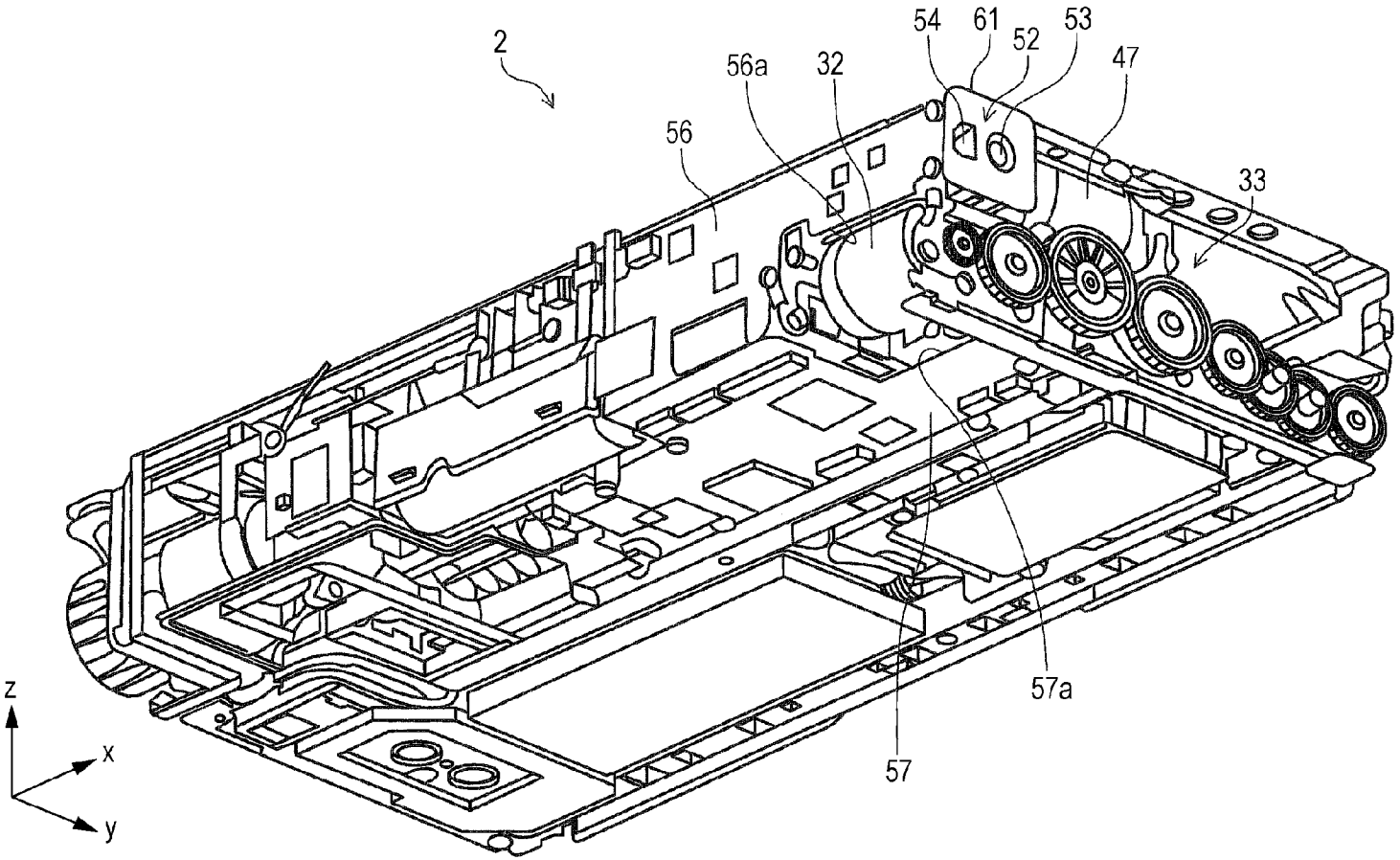
FIG. 14 is a perspective view of the apparatus main body of the printer according to the invention viewed from the bottom side.
Figure 15:
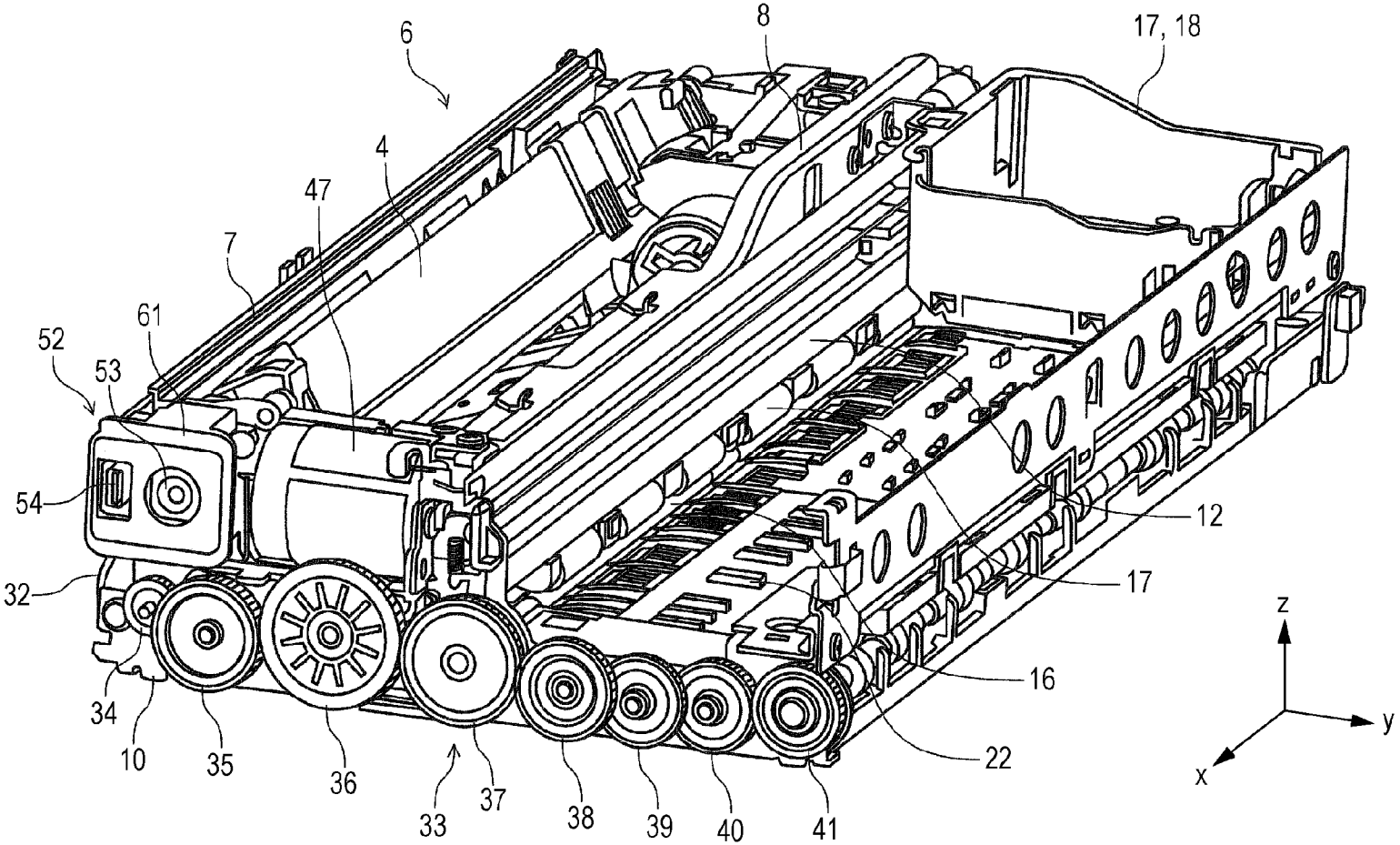
FIG. 15 is a perspective view of the apparatus main body of the printer according to the invention viewed from a top side.
Figure 16:
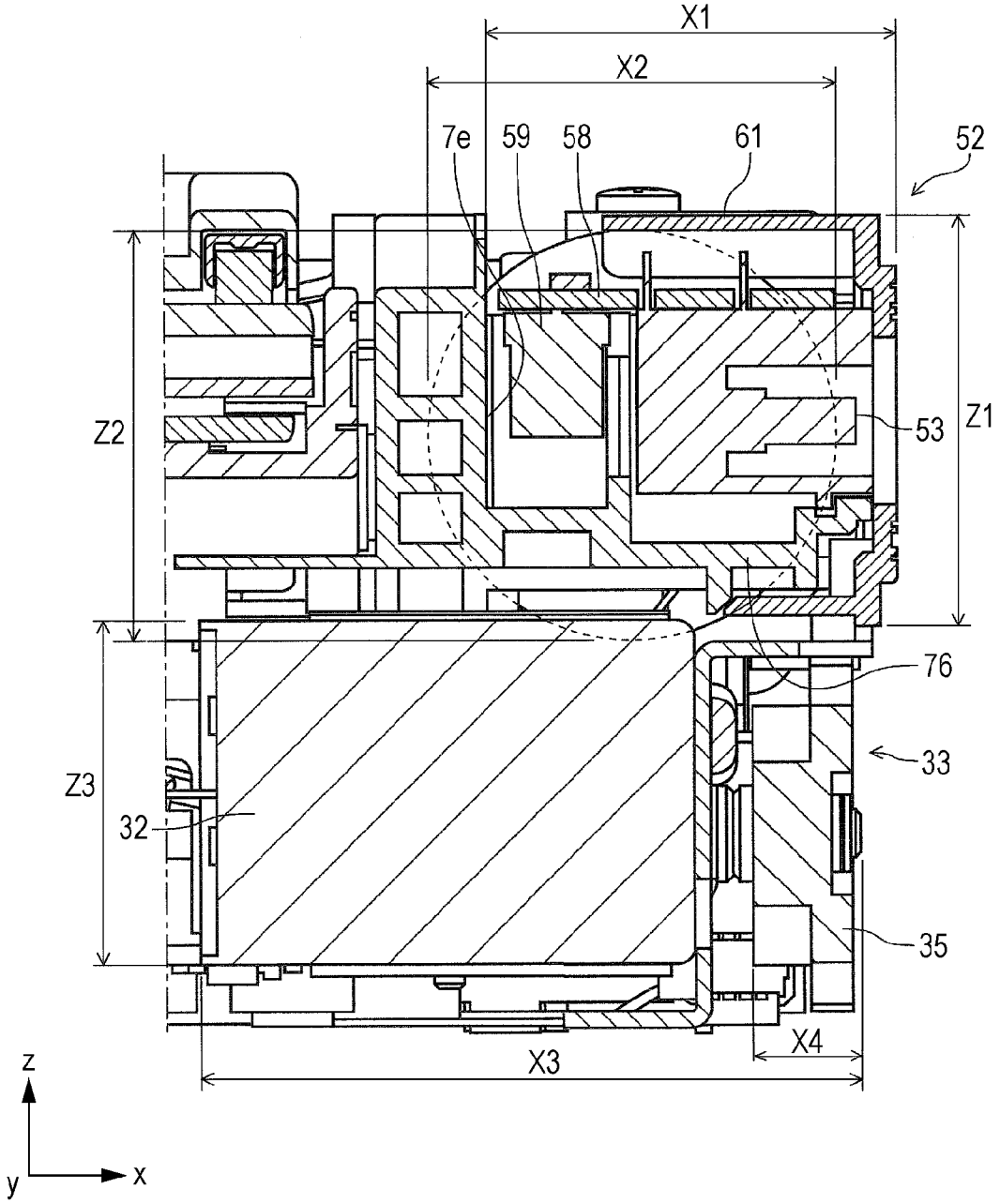
FIG. 16 is a cross-sectional view of the transporter drive motor and a connection section taken along plane x-z.
Figure 17:
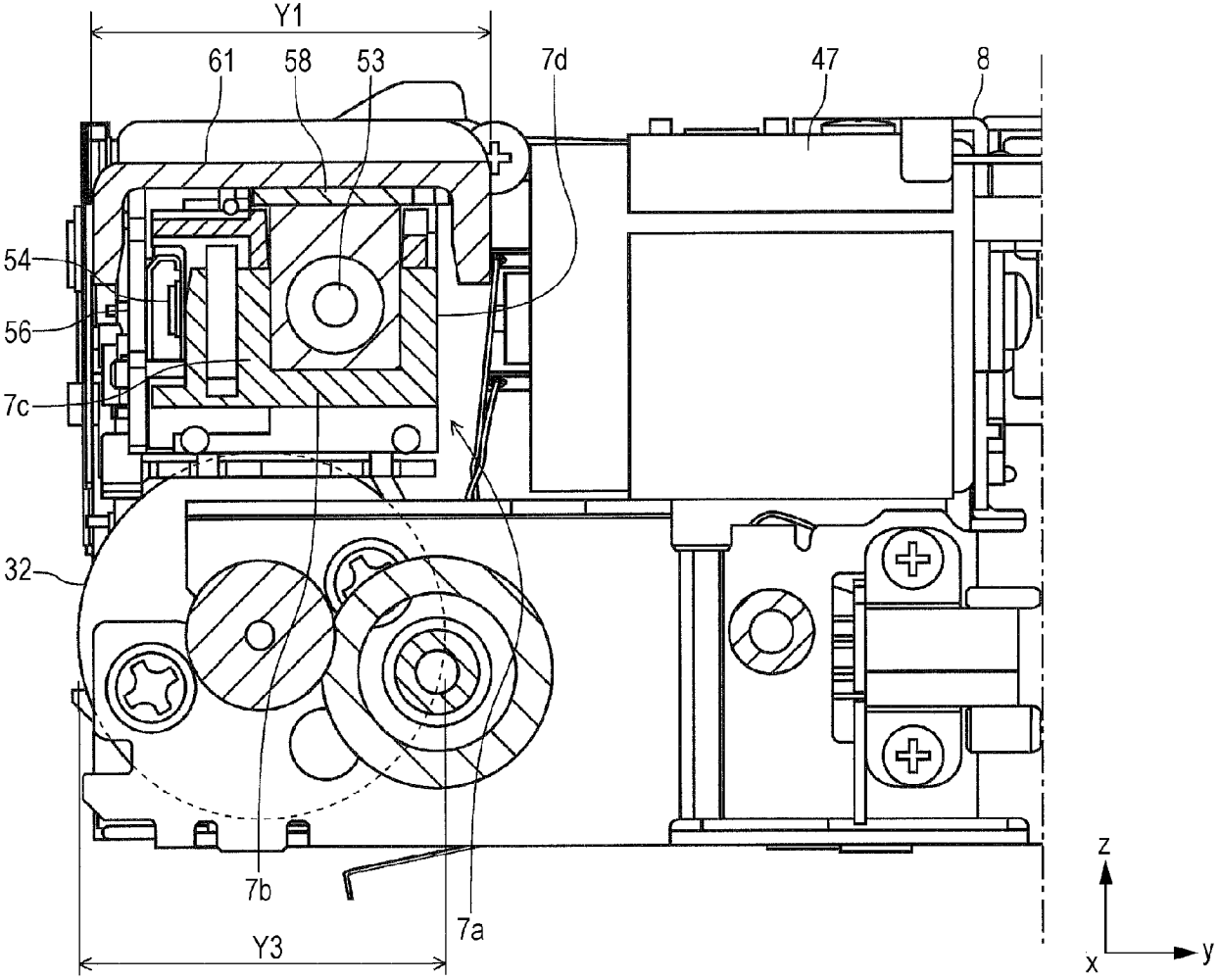
FIG. 17 is a cross-sectional view of the connection section taken along plane y-z.
Figure 18:
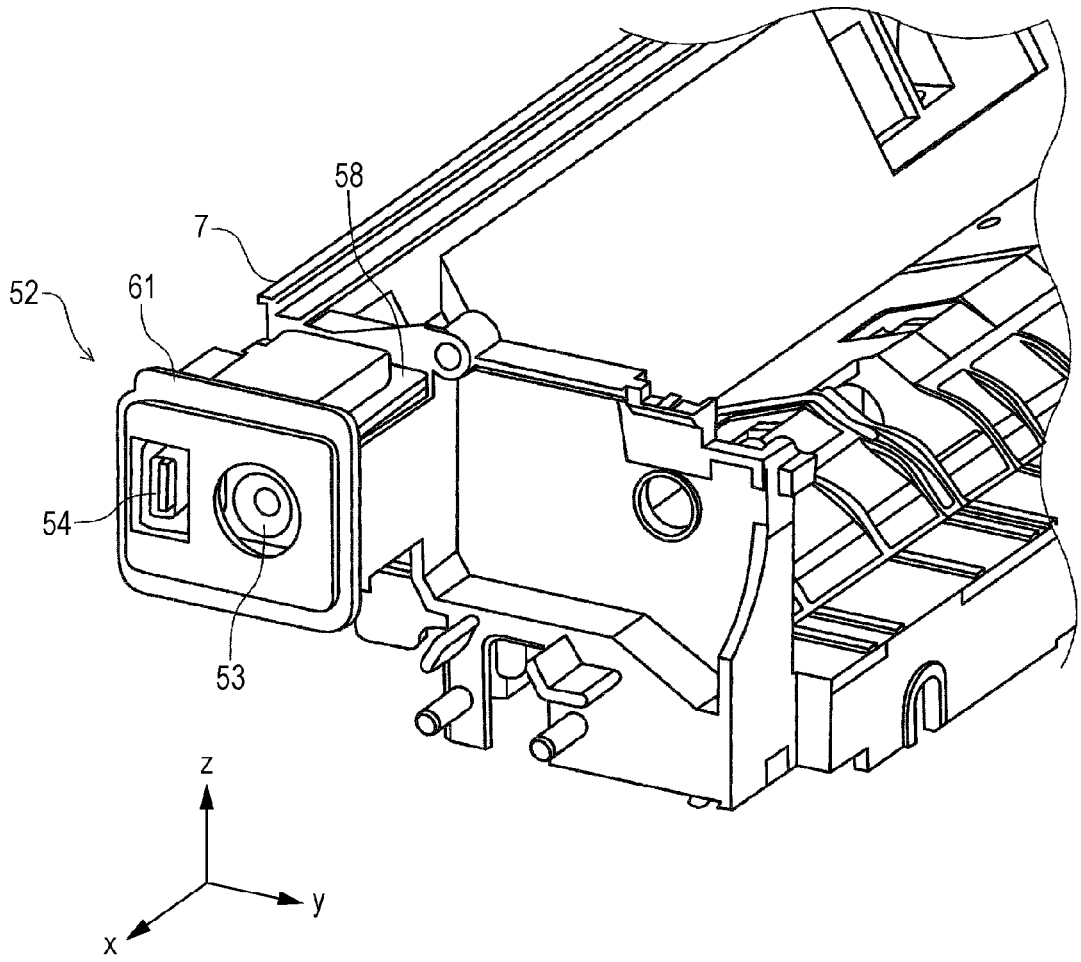
FIG. 18 is a perspective view of a state in which the connection section is attached to a base member configuring a feeding section.
Figure 19:
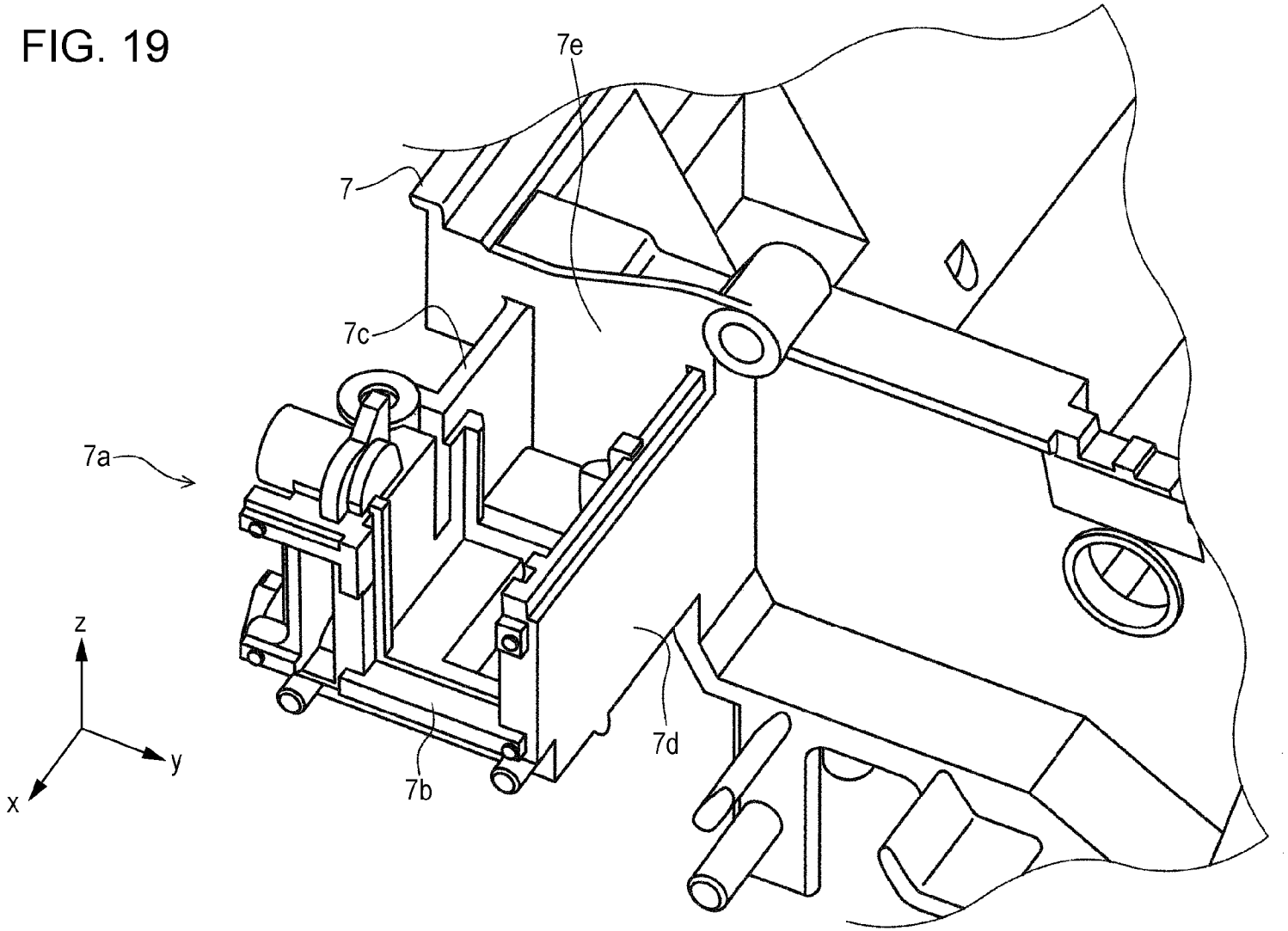
FIG. 19 is a perspective view of the base member configuring the feeding section.

Moreover, FIG. 13 is an external perspective view of the printer 1 viewed from a bottom side, FIG. 14 is a perspective view of the apparatus main body 2 viewed from the bottom side, FIG. 15 is a perspective view of the apparatus main body 2 viewed from a top side, FIG. 16 is a cross-sectional view of the transporter drive motor 32 and a connection section 52 taken along plane x-z, FIG. 17 is a cross-sectional view of the connection section 52 taken along plane y-z, FIG. 18 is a perspective view of a state in which the connection section 52 is attached to a base member 7 configuring a sheet feeding section 6, and FIG. 19 is a perspective view of the base member 7 configuring the sheet feeding section 6.

Incidentally, in an x-y-z orthogonal coordinate system shown in each drawing, an x direction and a y direction are horizontal directions, and the x direction of these is a direction (sheet width direction) orthogonal to a sheet transport direction, a left and right direction of the apparatus, and a movement direction (main scanning direction) of the carriage 17. In addition, the y direction is a sheet transport direction, and an apparatus depth direction. Furthermore, a z direction is a direction of gravity and an apparatus height direction.

Hereinafter, an overall configuration of the printer 1 will be described referring to FIGS. 1 to 4. The printer 1 is a so-called serial type ink jet printer which completes a recording by alternately performing a recording operation and a sheet transport operation, and is configured to be compact in consideration of portability. A reference numeral 28 in FIG. 1 represents a housing which configures an appearance of the apparatus, and is formed from a resin material, a reference numeral 29 represents a top cover which is formed from a resin material in the same manner as above, and a reference numeral 30 represents a front cover which is formed from a resin material in the same manner as above. A top cover 29 and a front cover 30 are integrally formed, and by opening these, an operation panel (not shown) and a sheet feeding port (not shown) appear on a top surface of the apparatus and a sheet discharge port appears on a front surface of the apparatus. The reference numeral 30*a* is an operation lever which releases a lock of the front cover 30.

The apparatus main body 2 shown in FIGS. 2 to 4 configures an inner side of the housing 28 described above. The apparatus main body 2 is mainly configured to have a plurality of frames. Specifically, the apparatus main body 2 is configured to have a main frame 8, a side frame 9, a side frame 10, a sub-frame 11, a guide frame 12, and a guide frame 13. An interval between these frames and the housing 28 is set to be extremely narrow for reduction in size.

A sheet feeding section 6 which feeds a recording sheet (mainly cut-sheet: hereinafter referred to as "sheet P") as an example of a medium is provided at a back of the apparatus. A reference numeral 3 represents a feeding port in which the sheet P can be set, and a plurality of sheets P set in the feeding port 3 are supported in an inclined position by a hopper 4 and a paper support (not shown) which is positioned on a top of the hopper 4. The feeding port 3 is formed among a hopper 4, a right side wall 3*a*, and a left side wall 3*b*.

The hopper 4 in FIG. 4 causes the sheet P which is supported to advance and retract with respect to a feed roller 5 by swinging around a swing fulcrum (not shown). An uppermost of the sheets P which are set is in contact with the feed roller 5 by raising the hopper 4, and then is fed to a downstream side by a rotation of the feed roller 5.

A sheet transporter which includes a transport drive roller 16 and a transport driven roller 15 is provided at the downstream side of the feed roller 5, and the sheet P is transported to a bottom of an ink jet recording head 21 by these rollers. The transport drive roller 16 is driven in a rotated manner by the transporter drive motor 32 (FIGS. 9 to 11) which is a drive source.

The transport driven roller 15 is supported to be freely rotatable by a roller support member 14 and is pressed toward the transport drive roller 16 by a biasing means (not shown) which applies a pressing force to the roller support member 14. Then, the transport driven roller 15 is driven to be rotated in contact with the transported sheet P. The transport drive roller 16 is formed to have a metal solid shaft or a metal hollow shaft, and the transport driven roller 15 is formed from a resin material (for example, polyoxymethylene (POM)) and the like.

The ink jet recording head 21 is provided on the carriage 17, and the carriage 17 is equipped with an ink cartridges 20A and 20B, and receives power from the carriage drive motor 47 (FIGS. 2, 3, and 9 to 11) to reciprocate in the sheet width direction (x direction). In the embodiment, a right end of FIGS. 2 and 3 in a movement region (movement range) of the carriage 17 is a home position of the carriage 17. The home position herein means a standby position of the carriage 17 during non-printing time or power-off.

In a following, a movement direction of the carriage 17 when the carriage 17 moves from an right end (home position) to a left end is set to be a second direction, and a movement direction of the carriage 17 when the carriage 17 moves from the left end to the right end is set to be a first direction.

Subsequently, the carriage 17 has a housing configured to have a carriage main body 18 formed in a box shape as shown in FIG. 5, and has the ink cartridges 20A and 20B installed in the carriage main body 18. Then, an ink is supplied from the ink cartridges 20A and 20B to the ink jet recording head 21. The ink cartridges 20A and 20B is detachably attached to the carriage main body 18, and reference numerals 19A and 19B represent a lever which releases a lock on the carriage main body 18 of the ink cartridges 20A and 20B, respectively.

The carriage 17 in the embodiment is a so-called on-carriage type which is mounted with the ink cartridges 20A and 20B, but may be a so-called off-carriage type in which the ink cartridges 20A and 20B are provided independently from the carriage 17, and the ink cartridges 20A and 20B are connected to the recording head 21 by an ink tube.

Back to FIG. 4, the carriage main body 18 has a first supported portion 18*a* on a front side of the apparatus, and has a second supported portion 18*b* at a rear side of the apparatus. The first supported portion 18*a* is supported by the guide frame 13, and the second supported portion 18*b* is supported by the guide frame 12. The carriage 17 is supported by the guide frame 13 and the guide frame 12. In addition, the first supported portion 18*a* is supported by the guide frame 13 and slides on the guide frame 13.

In the same manner, the second supported portion 18*b* is supported by the guide frame 12, and slides on the guide frame 12. Furthermore, the guide frame 12 defines a y direction position of the carriage 17. The guide frame 12 guides the carriage 17 in the main scanning direction.

Subsequently, a sheet supporting member 22 which supports the sheet P is provided at a position facing the ink jet recording head 21, and a gap between the sheet P and the ink jet recording head 21 is defined by the sheet supporting member 22. A discharge drive roller 25 and a discharge driven roller 26 which discharge the sheet P on which a recording is performed are provided at a downstream side of the ink jet recording head 21 and the sheet supporting member 22. A reference numeral 25*a* is a rotation shaft of the discharge drive roller 25, and a plurality of the discharge drive rollers 25 are provided at appropriate intervals along a shaft direction of the rotation shaft 25*a* (refer to FIGS. 2 and 3). In addition, a reference numeral 24 is a regulation roller which regulates a sheet floating.

Subsequently, a frame which configures a framework of the apparatus main body 2 will be described. The main frame 8, the sub-frame 11, and the guide frames 12 and 13 are formed to extend in the sheet width direction, and side frames 9 and 10 are formed to extend in the sheet transport direction in FIGS. 2 and 3. FIG. 3 shows a state in which the guide frame 13 after removing the sub-frame 11 from the guide frame of FIG. 2 is exposed.

The main frame 8 extends in an up and down direction as shown in FIG. 4 in a cross-section view, and has a top bent in an L shape at the rear side of the apparatus, and a bottom bent in an L shape at the front side of the apparatus. Various types of components such as a carriage drive motor 47 which drives the carriage 17 or a roller support member 14 which supports the transport driven roller 15 are assembled on the main frame 8.

In the embodiment, the carriage drive motor 47 is arranged between a left side wall 3*b* which configures a feeding port 3 of the sheet feeding section 6 and the housing 28 (FIG. 1) as shown in FIGS. 2 and 3. It is possible to suppress the apparatus not to be increased in size by arranging the carriage drive motor 47 using a narrow space between the housing 28 and a left side wall 3*b* of the sheet feeding section 6. The left side wall 3*b* is a part of the base member 7 which configures a base of the sheet feeding section 6.

The side frames 9 and 10 are joined to an end of the guide frames 12 and 13, respectively, and various types of elements which configure a sheet transport path such as the transport drive roller 10, the discharge drive roller 25, and the sheet supporting member 22 which are described referring to FIG. 4 are assembled.

Subsequently, the carriage 17 (carriage main body 18) according to the embodiment will be further described. The carriage 17 has a housing configured to have the carriage main body 18 formed in a box shape as described above. A reference numeral 18*h* in FIG. 5 represents a side surface of a second direction side among side surfaces configuring a periphery of the carriage main body 18 (hereinafter, referred to as "left side surface").

Moreover, the reference numeral 18*f* represents a projecting portion projecting in a second direction (a direction opposite to the home position of the carriage 17). The left side surface 18*h* is formed in the projecting portion 18*f*.

A belt clamp portion 18*k* is provided on a back surface side of the carriage main body 18. The belt clamp portion 18*k* is a portion which clamps (grips) an endless belt 48, and the belt clamp portion 18*k* receives a drive force from the endless belt 48. The endless belt 48 is stretched over an entire carriage movement region, and runs by receiving power of the carriage drive motor 47 to move the carriage 17.

Then, the gear group 33 which functions as the power transmission mechanism which transmits power of the transporter drive motor 32 to the transport drive roller 16 and the discharge drive roller 25 which configure a transporter that transports the sheet P will be described referring to FIGS. 6 to 11. The transporter drive motor 32 is provided on the rear side in a front and back direction of the apparatus. The gear group 33 includes a plurality of gears which transmit power to the transport drive roller 16 positioned at a center in the front and back direction of the apparatus and the discharge drive roller 25 (the rotation shaft 25*a*) positioned on a front side in the front and back direction of the apparatus.

Each gear which configures the gear group 33 is provided in the side frame 10, and more specifically is provided on an outer side (outside the apparatus) of the side frame 10. The gear group 33 is configured to include gears such as gears 34, 35, 36, 37, 38, 39, 40, and 41 as shown in FIG. 10 sequentially from the transporter drive motor 32 side. The gear 34 is a gear provided in a rotation shaft 32*a* of the transporter drive motor 32, the gear 37 is a gear provided in a shaft end of the transport drive roller 16, and the gear 41 is a gear provided in a shaft end of the rotation shaft 25*a* of the discharge drive roller 25. The gear group 33 transmits power to the discharge drive roller 25 (the rotation shaft 25*a*) through the gear 37.

A rotary scale 45 in addition to the gear 37 is provided in a shaft end of the transport drive roller 16 (FIGS. 7, 8, and 10). The rotary scale 45 configures a rotation detection means which detects a rotation of the transport drive roller 16, and is provided so that a detector 44 (FIG. 7) which detects a rotation of the rotary scale 45 is interposed across outer peripheries of the rotary scale 45. The rotary scale 45 and the detector 44 configure a rotation detection means, and a control unit (not shown) of the printer 1 can get an amount of rotation and a rotation direction of the transport drive roller 16 and the discharge drive roller 25 based on a detection signals from the detector 44.

In the configuration described above, FIG. 6 shows a state in which the carriage 17 is positioned at an end of the second direction. As shown in the figure, the gears 38, 39, and 40 among gears configuring the gear group 33 in the embodiment are entirely positioned on a bottom side of the carriage 17, and a portion of the gears 37 and 41 is positioned on the bottom side of the carriage 17.

Since at least a portion of the gear group 33 is positioned under the carriage 17 which is moved to an end of the second direction in this manner, the gear group 33 gets into a region necessary for a movement of the carriage 17, and thereby it is possible to suppress a width dimension of the apparatus. In addition, the width dimension of the apparatus can be suppressed even if a width of the carriage 17 is secured, such that it is possible to secure a volume of the carriage 17 and a volume of the ink cartridges 20A and 20B.

Moreover, the carriage 17 in the embodiment includes the projecting portion 18*f* projecting in the second direction, such that it is possible to secure the volume of the carriage 17 using the projecting portion 18*f*, and since at least a portion of the gear group 33 is positioned under the projecting portion 18*f* of the carriage 17 which is moved to the end of the second direction, it is possible to suppress a width dimension of the apparatus not to be increased. In addition, since a carriage volume can be secured without increasing the carriage main body 18 in a height direction, it is possible to suppress a height of the apparatus not to be increased.

Then, the ink cartridge 20B occupies a space including the projecting portion 18*f* in the carriage 17, such that it is possible to secure an ink capacity of the ink cartridge 20B.

Moreover, the rotary scale 45 which configures the rotation detection means 43 detecting a rotation of the transport drive roller 16 serving as a first roller is formed to have a diameter smaller than that of the gear 37 as shown in FIG. 10. Accordingly, it is possible to particularly protect the rotary scale 45 from an external pressure from above the apparatus. In addition, the rotary scale 45 is provided on a side (the side frame 10 side) of the first direction with respect to the gear 37. Therefore, the detector 44 which reads the rotary scale 45 is also arranged between the gear group 33 and the side frame 10 as shown in FIG. 7. Thus, the detector 44 can avoid being arranged on an outermost side (an outer side in the carriage movement direction) of the apparatus main body, such that it is possible to suppress a dimension (a dimension in the carriage movement direction) of the apparatus main body not to be increased.

In addition, the rotary scale 45 is weak in terms of strength, and detection accuracy is easily lowered by a little distortion, and thereby a recording quality is easily lowered. However, since the rotary scale 45 is provided on a side (the side frame 10 side) of the first direction with respect to the gear 37 serving as a first roller drive gear in the embodiment, it is possible to protect the rotary scale 45 or the detector 44 from an external pressure from a side of the apparatus.

In addition, since a convex portion 10*a* which is along an outer shape of the rotary scale 45 and is made in an arc shape with a diameter larger than a diameter of the rotary scale 45 is formed in the side frame 10 which supports the transport drive roller 16 as shown in FIG. 7, the convex portion 10*a* functions as a shielding wall with respect to the rotary scale 45, and it is possible to suppress an ink mist not to adhere to the rotary scale 45.

The concave portion 18*j* which avoids the convex portion 10*a* is formed in the carriage main body 18 when the carriage 17 is positioned at an end of the second direction (FIG. 5). That is, when the carriage 17 is positioned at the end of the second direction (a state of FIG. 6), the convex portion 10*a* gets into the concave portion 18*j*. Accordingly, the side frame 10 is not necessarily set to be positioned outside so as to secure the movement region of the carriage 17 (so as to prevent interference with the carriage main body 18 and the side frame 10), and it is possible to suppress the width dimension of the apparatus not to be increased.

Subsequently, a relationship between the gear group 33 and the carriage drive motor 47 will be described. In FIGS. 9 to 11, the carriage drive motor 47 is attached to the main frame 8, and more specifically, is fixed to the main frame 8 so that a rotation shaft of the carriage drive motor 47 is almost parallel to a y shaft direction.

At least a portion of the gear group 33 serving as the power transmission mechanism is located at the same position as a portion of the carriage drive motor 47 in a movement direction (x direction) of the carriage 17. In other words, a region occupied by the gear group 33 and a region occupied by the carriage drive motor 47 have an overlapping portion in the movement direction (x direction) of the carriage 17. A reference numeral X0 in FIG. 11 represents the overlapping portion.

More specifically, the gear 36 which is a portion of the gear group 33 is positioned on the bottom side of the carriage drive motor 47 in the embodiment (FIGS. 10 and 11). For convenience of description in FIG. 11, the gear 35 shown in FIG. 10 is omitted.

In this manner, since at least a portion of the carriage drive motor 47 and at least a portion of the gear group 33 which is the power transmission mechanism are located at the same position as each other in the movement direction of the carriage 17 in the embodiment, a dimension of each of the carriage drive motor 47 and the gear group 33 is not independently added to a dimension of the apparatus (x direction: a width dimension in the embodiment) in the movement direction of the carriage 17, and accordingly it is possible to suppress the dimension of the apparatus in the movement direction of the carriage 17.

In addition, since the gear group 33 is positioned on the bottom side of the carriage drive motor 47 in the embodiment, it is possible to suppress a dimension of the apparatus in the direction (y direction: a depth dimension in the embodiment) intersecting with the movement direction of the carriage 17.

In addition, in the embodiment, at least a portion of the carriage drive motor 47 and at least a portion of the gear group 33 serving as the power transmission mechanism are located at the same position as each other in the vertical direction as shown in FIG. 11. In other words, the region occupied by the carriage drive motor 47 and the region occupied by the gear group 33 have an overlapping region in the vertical direction. A reference numeral Z2 in FIG. 11 represents the overlapping region.

Accordingly, a dimension of each of the carriage drive motor 47 and the gear group 33 is not independently added to the dimension of the apparatus in the vertical direction, and accordingly, it is possible to suppress the dimension of the apparatus in the vertical direction.

In the embodiment, since the side frame 10 extending in a direction (y direction) intersecting with the movement direction of the carriage 17 is included in an end region on one side of a movement region of the carriage 17 as shown in FIG. 10, and the gear group 33 includes a plurality of gears arranged in an extending direction (y direction) of the side frame 10, a space occupied by the gear group 33 in the movement direction (x direction) of the carriage 17 can be reduced.

In the embodiment, at least a portion of the carriage drive motor 47 and at least a portion of the transporter drive motor 32 are located at the same position as each other in the vertical direction as shown in FIG. 11. In other words, the region occupied by the carriage drive motor 47 and the region occupied by the transporter drive motor 32 have an overlapping portion in the vertical direction. The reference numeral Z1 in FIG. 11 represents the overlapping portion.

In contrast, a dimension of each of the carriage drive motor 47 and the transporter drive motor 32 is not independently added to a dimension of the apparatus in the vertical direction, and accordingly, it is possible to suppress the dimension of the apparatus in the vertical direction.

In the same manner, in the embodiment, at least a portion of the carriage drive motor 47 and at least a portion of the transporter drive motor 32 are located at the same position as each other in the movement direction (x direction) of the carriage 17 as shown in FIG. 11. In other words, the region occupied by the carriage drive motor 47 and the region occupied by the transporter drive motor 32 have an overlapping portion in the movement direction of the carriage 17. A reference numeral X1 in FIG. 11 represents the overlapping portion.

Accordingly, the dimension of each of the carriage drive motor 47 and the transporter drive motor 32 is not independently added to a dimension of the apparatus in the movement direction of the carriage 17, and accordingly, it is possible to suppress the dimension of the apparatus in the movement direction of the carriage 17.

The above is a positional relationship between the carriage drive motor 47 and the transporter drive motor 32 in the embodiment, but at least a portion of the carriage drive motor 47 and at least a portion of the transporter drive motor 32 can be located at the same position as each other in a direction (for example, the y direction) intersecting with the movement direction of the carriage 17. In other words, the region occupied by the carriage drive motor 47 and the region occupied by the transporter drive motor 32 can be arranged so as to have an overlapping portion in the direction intersecting with the movement direction of the carriage 17. FIG. 12 shows such an embodiment, and a reference numeral Y1 represents the overlapping portion.

According to such a modification example, the dimension of each of the carriage drive motor 47 and the transporter drive motor 32 is not independently added to a dimension of the apparatus (the y direction in FIG. 12) in the direction intersecting with the movement direction of the carriage 17, and accordingly, it is possible to suppress the dimension of the apparatus in the direction intersecting with the movement direction of the carriage 17.

An arrangement relationship between the carriage drive motor 47 and the transporter drive motor 32 may be one of three overlaps such as an overlap represented by the reference numeral X1 in FIG. 11, an overlap represented by the reference numeral Z1, and an overlap represented by the reference numeral Y1 in FIG. 12, and can be an appropriate combination of these. As the combination, for example, a combination of two overlaps such as the overlap X1 and the overlap Y1, the overlap X1 and the overlap Z1, the overlap Y1 and the overlap Z1, or a combination of all overlaps of X1, Y1 and Z1 is considered.

Subsequently, an arrangement of a connection section 52 will be described referring to FIGS. 13 to 19. The printer 1 is configured to receive power from an AC adapter which is an external power supply source (not shown) to be operated, and the reference numeral 52 in FIGS. 13 and 14 represents a connection section which is provided on a left side surface of the printer 1 and to which the AC adapter is connected. The connection section 52 is a position at the rear side of the apparatus in the left side surface of the printer 1, is adjacent to a rear surface (a rear surface 28*a* of the housing 28) of the apparatus, and includes a first plug connection section 53 and a second plug connection section 54.

The first plug connection section 53 is a connection section to which a connection section plug of the external AC adapter (not shown) described above is connected, and the second plug connection section 54 is a connection section for an input/output interface to which a connection section plug of an information transmission cable (not shown) is connected. For example, a universal serial bus (USB) is exemplified as an example of the input/output interface. In addition, the input/output interface can be provided with power from an external computer.

Power and an information signal supplied from the outside through the connection section 52 are supplied to a board 56 and a board 57 which configure a control unit as an example in the printer 1. The board 56 of these is a circuit board which is provided along a back surface of the apparatus main body 2 in a substantially vertical manner as shown in FIG. 14, and the board 57 is a circuit board which is provided along a bottom surface of the apparatus main body 2 in a substantially horizontal manner.

The boards 56 and 57 do not form a complete rectangle shape in the embodiment, and a notch represented by a reference numeral 56*a* and a notch represented by a reference numeral 57*a* are formed in the board 56 and the board 57, respectively. Then, the transporter drive motor 32 gets into the notch 56*a* of the board 56, and gets into the notch 57*a* formed in the board 57.

Accordingly, a dimension of the boards 56 and 57 and a dimension of the transporter drive motor 32 are not independently added to a depth dimension and a height dimension of the apparatus, and thereby a reduction in size of the apparatus is achieved.

Subsequently, a connection section attaching portion 7*a* is formed in an end (end in the width direction of the apparatus) of the base member 7 configuring a base of the sheet feeding section 6 shown in FIG. 15 so as to project in an outer side direction of the apparatus as shown in FIG. 19. The connection section 52 is attached to the connection section attaching portion 7*a*. All of the base member 7 is integrally formed of a resin material, and the connection section attaching portion 7*a* is also formed of a resin material integrally with all of the base member 7.

The connection section attaching portion 7*a* forms a substantially U shape whose top is opened, using a bottom wall 7*b*, a side wall 7*c*, and a side wall 7*d*, and further includes a back wall 7*e* which is a partition of the sheet feeding section 6 side. That is, the connection section attaching portion 7*a* is formed to have two directions of the top and an end in the width direction opened.

Then, as shown in FIGS. 16, 17, and 18, a board 58 configuring the first plug connection section 53 is attached so as to cover the top of the connection section attaching portion 7*a*.

Electronic components 59 (for example, capacitors, and the like) are attached to the board 58, and the board 58 is attached so as to cover the top of the connection section attaching portion 7*a* with the electronic components 59 regarded as the bottom side.

Accordingly, a top opening of the connection section attaching portion 7*a* is closed, and a first connection section 53 is attached so as to close remaining openings of the connection section attaching portion 7*a*. In this manner, the electronic components 59 attached to the board 58 are arranged in a closed space whose all directions are blocked.

The second plug connection section 54 is attached to the board 56, and is attached to an outer side of the connection section attaching portion 7*a*. After the first plug connection section 53 and the second plug connection section 54 are attached, a cover 61 for forming a sense of unity with the housing 28 (FIG. 13) in appearance is attached. Accordingly, an outer surface of the connection section 52 is flush with the housing 28.

Subsequently, a relationship between the connection section 52 and a component on a periphery of the connection section 52 will be described. First, at least a portion of the carriage drive motor 47 and at least a portion of the connection section 52 are located at the same position as each other in the movement direction (x direction) of the carriage 17 in the embodiment. The reference numeral X1 in FIG. 16 is a region occupied by the connection section 52 in the X direction, and the reference numeral X2 is a region occupied by the carriage drive motor 47 in the x direction.

As is clear from FIG. 16, at least a portion of the carriage drive motor 47 and at least a portion of the connection section 52 are located at the same position as each other in the x direction. In other words, at least a portion of the carriage drive motor 47 and at least a portion of the connection section 52 are overlapped in the x direction. Accordingly, a dimension of each of the carriage drive motor 47 and the connection section 52 is not independently added to the dimension of the apparatus in the X direction, and thereby it is possible to suppress the dimension of the apparatus in the X direction.

In addition, at least a portion of the carriage drive motor 47 and at least a portion of the connection section 52 are located at the same position as each other in the vertical direction (z direction) in the embodiment. A reference numeral Z1 in FIG. 16 is a region occupied by the connection section 52 in the z direction, and a reference numeral Z2 is a region occupied by the carriage drive motor 47 in the z direction.

As is clear from FIG. 16, at least a portion of the carriage drive motor 47 and at least a portion of the connection section 52 are located at the same position as each other in the z direction. In other words, at least a portion of the carriage drive motor 47 and at least a portion of the connection section 52 are overlapped in the z direction. Accordingly, a dimension of each of the carriage drive motor 47 and the connection section 52 is not independently added to the dimension of the apparatus in the z direction, and thereby it is possible to suppress the dimension of the apparatus in the z direction.

In addition, at least a portion of the transporter drive motor 32 and at least a portion of the connection section 52 are located at the same position as each other in the movement direction (x direction) of the carriage 17 in the embodiment. A reference numeral X3 in FIG. 16 is a region occupied by the transporter drive motor 32 in the x direction.

As is clear from FIG. 16, at least a portion of the transporter drive motor 32 and at least a portion of the connection section 52 are located at the same position as each other in the x direction. In other words, at least a portion of the transporter drive motor 32 and at least a portion of the connection section 52 are overlapped in the x direction. Accordingly, a dimension of each of the transporter drive motor 32 and the connection section 52 is not independently added to the dimension of the apparatus in the x direction, and thereby it is possible to suppress the dimension of the apparatus.

Moreover, at least a portion of the transporter drive motor 32 and at least a portion of the connection section 52 are located at the same position as each other in the direction (y direction) intersecting with the movement direction (x direction) of the carriage 17 in the embodiment. A reference numeral Y1 in FIG. 17 is a region occupied by the connection section 52 in the y direction, and a reference numeral Y3 is a region occupied by the transporter drive motor 32 in the y direction.

As is clear from FIG. 17, at least a portion of the transporter drive motor 32 and at least a portion of the connection section 52 are located at the same position as each other in the y direction. In other words, at least a portion of the transporter drive motor 32 and at least a portion of the connection section 52 are overlapped in the y direction. Accordingly, a dimension of each of the transporter drive motor 32 and the connection section 52 is not independently added to the dimension of the apparatus in the y direction, and thereby it is possible to suppress the dimension of the apparatus in the y direction.

Moreover, at least a portion of the gear group 33 serving as the power transmission mechanism and at least a portion of the connection section 52 are located at the same position as each other in the movement direction (x direction) of the carriage 17 in the embodiment. A reference numeral X4 in FIG. 16 is a region occupied by the gear group 33 in the x direction.

As is clear from FIG. 16, at least a portion of the gear group 33 and at least a portion of the connection section 52 are located at the same position as each other in the x direction. In other words, at least a portion of the gear group 33 and at least a portion of the connection section 52 are overlapped in the x direction. Accordingly, a dimension of each of the gear group 33 and the connection section 52 is not independently added to the dimension of the apparatus in the x direction, and thereby it is possible to suppress the dimension of the apparatus in the x direction.

In addition, at least a portion (a portion of a gear 34 and a gear 35 in the embodiment) of the gear group 33 is positioned on a bottom side of the connection section (FIGS. 15 and 17).

In the embodiment, the connection section 52 is on a rear side of the apparatus with respect to the carriage drive motor 47, and is positioned upper than the transporter drive motor 32 (FIG. 17). In this manner, the connection section 52 is arranged using a space formed by an arrangement of the carriage drive motor 47 and the transporter drive motor 32, and thereby it is possible to suppress the apparatus not to be increased in size.

In addition, the connection section 52 is arranged between the carriage drive motor 47 and the board 56 in the embodiment.

Moreover, the connection section 52 is provided using a portion of the base member 7 configuring a base of the sheet feeding section 6 in the embodiment. Accordingly, it is possible to configure the connection section 52 at a low cost by simplifying a structure in the embodiment.

In the embodiment, the guide frame 12 and the main frame 8 which extend in the movement direction (x direction) of the carriage 17 and support the carriage 17 are included, and the connection section 52 is positioned on the rear side of the apparatus with respect to the guide frame 12 and the main frame 8 (FIG. 17).

In the embodiment, the connection section 52 is configured to include the first plug connection section 53 and the second plug connection section 54, that is, connector connection section portion, but the connection section attaching portion 7*a* may be regarded as a configuration of the connection section 52.

Moreover, the connection section 52 is provided using a portion of the base member 7 configuring the base of the sheet feeding section 6, but may be also provided without using the portion of the base member 7.

The printer 1 according to the embodiment can be favorably reduced in size by an arrangement of the carriage drive motor 47, the transporter drive motor 32, the gear group 33, and the connection section 52 as described above.

However, an arrangement of each configuration described above is an example, and it is needless to mention that other various arrangements are possible. Moreover, it is not necessary to include all of the arrangements described above, and a configuration including at least a portion of the arrangements may be used.

The entire disclosure of Japanese Patent Application No. 2014-121354 filed on Jun. 12, 2014 and No. 2014-130370 filed on Jun. 25, 2014 are expressly incorporated by reference herein.

What is claimed is:

1. A recording apparatus comprising:

a carriage which includes a recording head performing a recording on a medium and is movable in a predetermined direction;

a carriage drive motor which drives the carriage;

a transporter which transports the medium;

a transporter drive motor which drives the transporter; and a power transmission mechanism which transmits power of the transporter drive motor to the transporter, wherein the carriage drive motor, the transporter drive motor and the power transmission mechanism are disposed near the side wall of the apparatus, wherein the movement direction of the carriage is the x direction, the transport direction of the medium is the y direction, and the vertical direction is the z direction, wherein a portion of the carriage drive motor and a portion of the power transmission mechanism are located overlapping in the x direction, and wherein the carriage drive motor is located between a carriage movement area and the transporter drive motor.

2. The recording apparatus according to claim 1, wherein at least a portion of the power transmission mechanism is located on a bottom side of the carriage drive motor.

3. The recording apparatus according to claim 2, wherein at least a portion of the carriage drive motor and at least a portion of the power transmission mechanism are located at the same position as each other in a vertical direction.

4. The recording apparatus according to claim 3, further comprising:

a frame which extends in a direction intersecting with the movement direction of the carriage in an end region on one side in a movement region of the carriage, wherein the power transmission mechanism includes a plurality of gears which are arranged in an extending direction of the frame.

5. The recording apparatus according to claim 1, wherein the portion of the carriage drive motor and the portion of the transporter drive motor are located overlapping in the z direction.

6. The recording apparatus according to claim 5, wherein the portion of the carriage drive motor and the portion of the transporter drive motor are located overlapping in the x direction.

7. The recording apparatus according to claim 6, wherein the portion of the carriage drive motor and the portion of the transporter drive motor are located overlapping in the y direction.

8. The recording apparatus according to claim 7, further comprising:

a medium feeding section which feeds a medium; and a housing which accommodates an apparatus main body that includes the carriage, the carriage drive motor, the transporter, the transporter drive motor, the power transmission mechanism, and the medium feeding section, wherein the medium feeding section includes a medium setting unit which sets a medium, and the carriage drive motor is arranged between the housing and the medium setting unit.

9. The recording apparatus according to claim 8, wherein the portion of the power transmission mechanism is positioned under the carriage which is moved to an end of a movable region of the carriage.

10. The recording apparatus according to claim 1, further comprising:

a connection section to which an external power supply source is connected, wherein the portion of the carriage drive motor and the portion of the connection section are located overlapping in the x direction.

11. The recording apparatus according to claim 1, further comprising:

the connection section to which the external power supply source is connected, wherein at least a portion of the carriage drive motor and at least a portion of the connection section are located overlapping in the z direction.

12. The recording apparatus according to claim 1, further comprising:

the connection section to which the external power supply source is connected, wherein the portion of the transporter drive motor and the portion of the connection section are located overlapping in the x direction.

13. The recording apparatus according to claim 1, further comprising:

the connection section to which the external power supply source is connected, wherein the portion of the transporter drive motor and the portion of the connection section are located overlapping in the y direction.

14. The recording apparatus according to claim 1, further comprising:

the connection section to which the external power supply source is connected, wherein the portion of the power transmission mechanism and the portion of the connection section are located overlapping in the x direction.

15. The recording apparatus according to claim 10, wherein the connection section includes an input/output interface.

16. The recording apparatus according to claim 11, wherein the connection section includes the input/output interface.

17. The recording apparatus according to claim 12, wherein the connection section includes the input/output interface.

18. The recording apparatus according to claim 13, wherein the connection section includes the input/output interface.

19. The recording apparatus according to claim 14, wherein the connection section includes the input/output interface.

* * * * *